US010504404B2

(12) United States Patent
Kim et al.

(10) Patent No.: US 10,504,404 B2
(45) Date of Patent: Dec. 10, 2019

(54) ELECTROLUMINESCENT DISPLAY AND DRIVING DEVICE THEREOF

(71) Applicant: LG Display Co., Ltd., Seoul (KR)

(72) Inventors: Kyungrok Kim, Paju-si (KR); Taegung Kim, Paju-si (KR); Byungjae Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 75 days.

(21) Appl. No.: 15/840,135

(22) Filed: Dec. 13, 2017

(65) Prior Publication Data

US 2018/0182278 A1 Jun. 28, 2018

(30) Foreign Application Priority Data

Dec. 28, 2016 (KR) ..... 10-2016-0181608

(51) Int. Cl.
*G09G 3/20* (2006.01)
*G09G 3/3233* (2016.01)
(Continued)

(52) U.S. Cl.
CPC ..... *G09G 3/2018* (2013.01); *G09G 3/3233* (2013.01); *G09G 3/3266* (2013.01);
(Continued)

(58) Field of Classification Search
CPC ... G09G 2310/0221; G09G 2310/0291; G09G 2310/08; G09G 2320/0233; G09G 2320/0285; G09G 2320/045; G09G 2360/04; G09G 2370/08; G09G 3/2018; G09G 3/3233; G09G 3/3266; G09G 3/3275
(Continued)

(56) References Cited

U.S. PATENT DOCUMENTS

2010/0302214 A1 12/2010 Kim et al.
2011/0248966 A1* 10/2011 Ahn ..... G09G 3/3611 345/204
(Continued)

FOREIGN PATENT DOCUMENTS

KR 10-2016-0061537 A 6/2016

OTHER PUBLICATIONS

Communication dated Mar. 15, 2018 from the European Patent Office in counterpart EP application No. 17206266.3.
(Continued)

*Primary Examiner* — Tony O Davis
(74) *Attorney, Agent, or Firm* — Morgan, Lewis & Bockius LLP

(57) ABSTRACT

An electroluminescent display and a driving device of the electroluminescent display are disclosed. The electroluminescent display includes first and second active areas divided from a screen, a first timing controller configured to transmit pixel data of the first active area to be displayed on the first active area to a first driving circuit writing pixel data to pixels of the first active area, a second timing controller configured to transmit pixel data of the second active area to be displayed on the second active area to a second driving circuit writing pixel data to pixels of the second active area, and a bridge circuit configured to distribute an input image to the first and second timing controllers and synchronize the first and second timing controllers when receiving a synchronization request signal from the first and second timing controllers.

21 Claims, 17 Drawing Sheets

(51) Int. Cl.
*G09G 3/3275* (2016.01)
*G09G 3/3266* (2016.01)

(52) U.S. Cl.
CPC ... *G09G 3/3275* (2013.01); *G09G 2310/0221* (2013.01); *G09G 2310/0291* (2013.01); *G09G 2310/08* (2013.01); *G09G 2320/0233* (2013.01); *G09G 2320/0285* (2013.01); *G09G 2320/045* (2013.01); *G09G 2360/04* (2013.01); *G09G 2370/08* (2013.01)

(58) Field of Classification Search
USPC ..... 345/204, 212–213, 690–691, 696
See application file for complete search history.

(56) References Cited

U.S. PATENT DOCUMENTS

2013/0027383 A1 1/2013 Odawara et al.
2013/0189595 A1 7/2013 Izuhara et al.
2015/0187278 A1* 7/2015 Park ..... G09G 3/3291 345/212
2015/0340013 A1 11/2015 Lee et al.
2016/0155421 A1 6/2016 Han et al.
2016/0189595 A1 6/2016 Choi et al.
2017/0098431 A1* 4/2017 Oh ..... G09G 3/20
2018/0033404 A1* 2/2018 Lee ..... G09G 5/18
2018/0061362 A1* 3/2018 Kim ..... G09G 5/003
2018/0114492 A1* 4/2018 Kim ..... G09G 3/2088
2018/0151124 A1* 5/2018 An ..... G09G 3/3266
2018/0182278 A1* 6/2018 Kim ..... G09G 3/2018
2018/0182288 A1* 6/2018 Kim ..... G09G 3/3233
2018/0275445 A1* 9/2018 Katagiri ..... G02F 1/13452

OTHER PUBLICATIONS

Extended European Search Report dated Jul. 13, 2018, issued in corresponding European Patent Application No. 17206266.3.

* cited by examiner

ELECTROLUMINESCENT DISPLAY AND DRIVING DEVICE THEREOF

This application claims the benefit of Korean Patent Application No. 10-2016-0181608 filed on Dec. 28, 2016, the entire contents of which is incorporated herein by reference for all purposes as if fully set forth herein.

BACKGROUND

Technical Field

The present disclosure relates to a high-resolution and large-screen electroluminescent display and a driving device of the electroluminescent display.

Discussion of the Related Art

With the development of process technology and driving circuit technology for display devices, the market for high-resolution display devices is expanding. Display devices having characteristics such as high resolution, color depth expansion, and high-speed drive have been developed to achieve high image quality.

Ultra-high definition (UHD) has 8.3 million pixels (=3840×2160). The number of pixels in UHD is about four times more than the number of pixels in full-high definition (FHD) that is 207 million (=1920×1080). Thus, the UHD can reproduce an input image more precisely than the FHD, thereby achieving clearer and smoother image quality. The pixel means a minimum unit dot constituting a computer display or a computer image. The number of pixels means pixels per inch (PPI).

A resolution of HD is expressed by "K", for example, 2K and 4K. "K" is a digital cinema standard and stands for "Kilo" or 1,000. "4K" is four times a resolution of FHD and is sometimes called quad full high definition (QFHD), ultra-definition (UD), or UHD. In recent years, researches on high-resolution and large-screen display devices of 8K resolution (7680×4320) have been actively conducted by leading companies of display devices.

A display device includes a display panel driving circuit for writing pixel data of an input image to pixels. The display panel driving circuit includes a data driver circuit supplying data signals to data lines of a pixel array and a gate driver circuit (or referred to as "scan driver circuit") sequentially supplying gate pulses (or referred to as "scan pulses") synchronized with the data signals to gate lines (or referred to as "scan lines") of the pixel array. The display panel driving circuit further includes a timing controller that transmits the pixel data of the input image to the data driver circuit and controls operation timings of the data driver circuit and the gate driver circuit.

An electroluminescent display is classified as an inorganic light emitting display and an organic light emitting diode display depending on a material of an emission layer. An active matrix organic light emitting diode display includes a plurality of organic light emitting diodes capable of emitting light by themselves and has many advantages, such as fast response time, high emission efficiency, high luminance, wide viewing angle, and the like. As a resolution of the electroluminescent display increases, a variation in driving characteristics between pixels increases depending on a position of the pixels on the screen over time. Thus, it is difficult to implement a high-resolution and large-screen electroluminescent display capable of making the image quality of entire screen uniform.

SUMMARY

Accordingly, embodiments of the present disclosure are directed to an electroluminescent display and a driving device thereof that substantially obviate one or more of the problems due to limitations and disadvantages of the related art.

An aspect of the present disclosure is to provide a high-resolution and large-screen electroluminescent display capable of uniformly implementing image quality of entire screen and a driving device of the electroluminescent display.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, an electroluminescent display comprises first and second active areas divided from a screen on which data lines and gate lines intersect each other and pixels are disposed, a first driving circuit configured to write pixel data to pixels of the first active area, a first timing controller configured to transmit the pixel data of the first active area to be displayed on the first active area to the first driving circuit and control the first driving circuit, a second driving circuit configured to write pixel data to pixels of the second active area, a second timing controller configured to transmit the pixel data of the second active area to be displayed on the second active area to the second driving circuit and control the second driving circuit, and a bridge circuit configured to distribute an input image to the first and second timing controllers and synchronize the first and second timing controllers when receiving a synchronization request signal from the first and second timing controllers through a communication path connected to the first and second timing controllers.

In another aspect, an electroluminescent display comprises a first active area disposed in an upper left portion of a screen, a second active area disposed in an upper right portion of the screen, a third active area disposed in a lower left portion of the screen, a fourth active area disposed in a lower right portion of the screen, a first driving circuit configured to write pixel data to pixels of the first active area, a first timing controller configured to transmit the pixel data of the first active area to be displayed on the first active area to the first driving circuit and control the first driving circuit, a second driving circuit configured to write pixel data to pixels of the second active area, a second timing controller configured to transmit the pixel data of the second active area to be displayed on the second active area to the second driving circuit and control the second driving circuit, a third driving circuit configured to write pixel data to pixels of the third active area, a third timing controller configured to transmit the pixel data of the third active area to be displayed on the third active area to the third driving circuit and control the third driving circuit, a fourth driving circuit configured to write pixel data to pixels of the fourth active area, a fourth timing controller configured to transmit the pixel data of the fourth active area to be displayed on the fourth active area to the fourth driving circuit and control the fourth driving circuit, and a bridge circuit configured to distribute an input image to the first to fourth timing controllers and synchronize the first to fourth timing controllers when receiving a synchronization request signal from the first to fourth timing controllers through a communication path connected to the first to fourth timing controllers.

In yet another aspect, a driving device of an electroluminescent display comprises a first timing controller configured to transmit pixel data of a first active area to be displayed on the first active area to a first driving circuit writing pixel data to pixels of the first active area and control the first driving circuit, a second timing controller configured to transmit pixel data of a second active area to be displayed on the second active area to a second driving circuit writing pixel data to pixels of the second active area and control the second driving circuit, and a bridge circuit configured to distribute an input image to the first and second timing controllers and synchronize the first and second timing controllers when receiving a synchronization request signal from the first and second timing controllers through a communication path connected to the first and second timing controllers.

In still yet another aspect, a driving device of an electroluminescent display comprises a first timing controller configured to transmit pixel data of a first active area to be displayed on the first active area to a first driving circuit writing pixel data to pixels of the first active area and control the first driving circuit, a second timing controller configured to transmit pixel data of a second active area to be displayed on the second active area to a second driving circuit writing pixel data to pixels of the second active area and control the second driving circuit, a third timing controller configured to transmit pixel data of a third active area to be displayed on the third active area to a third driving circuit writing pixel data to pixels of the third active area and control the third driving circuit, a fourth timing controller configured to transmit pixel data of a fourth active area to be displayed on the fourth active area to a fourth driving circuit writing pixel data to pixels of the fourth active area and control the fourth driving circuit, and a bridge circuit configured to distribute an input image to the first to fourth timing controllers, and synchronize the first to fourth timing controllers when receiving a synchronization request signal from the first to fourth timing controllers through a communication path connected to the first to fourth timing controllers.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
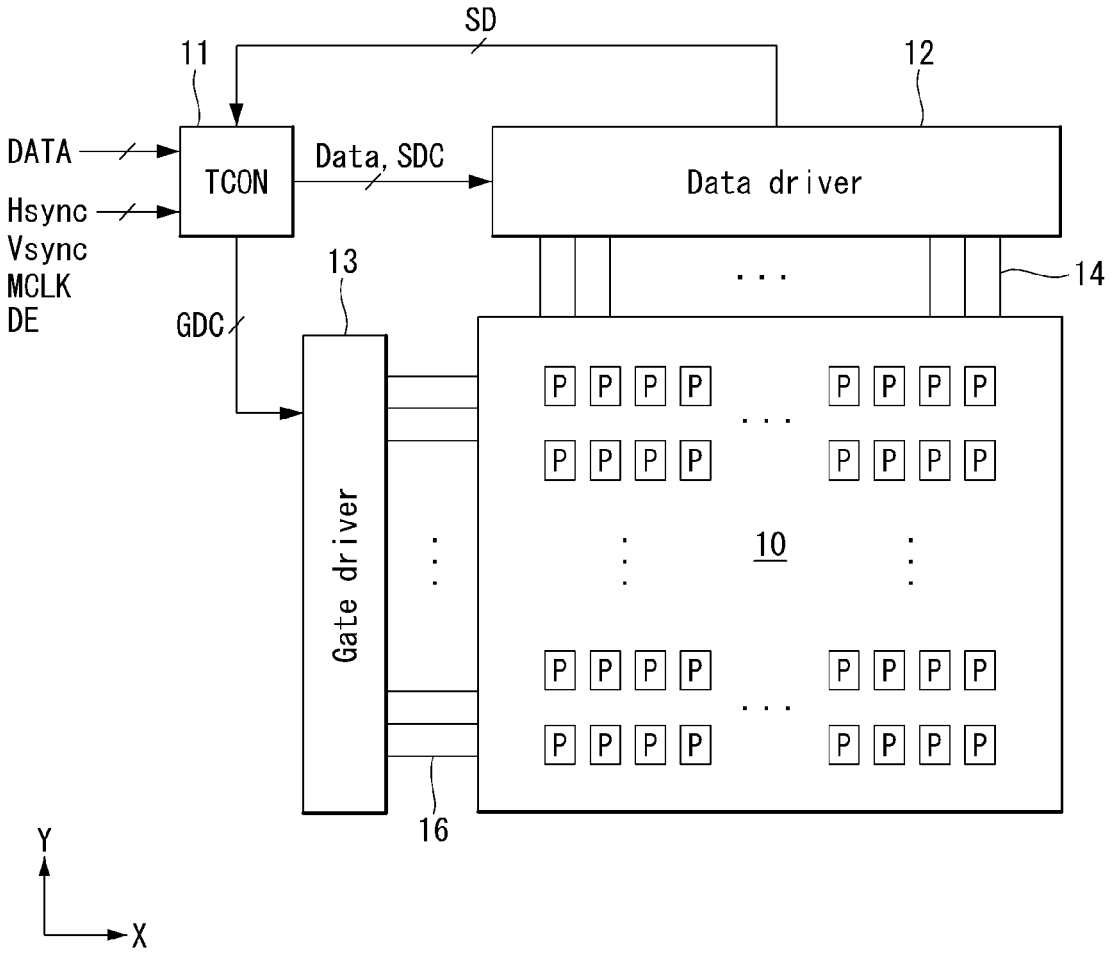
FIG. 1 is a block diagram schematically illustrating an electroluminescent display according to an example embodiment.

In the following description, example embodiments are described using an organic light emitting diode (OLED) display as an example of an electroluminescent display. However, embodiments are not limited thereto. Each pixel of an OLED display according to example embodiments includes a driving element for controlling a current flowing in an OLED. The driving element may be implemented as a transistor. It is preferable that the driving elements of all the pixels are designed to have the same electrical characteristics including a threshold voltage, mobility, etc. However, the electrical characteristics of the driving elements are not uniform due to process conditions, a driving environment, and the like. As a driving time of the OLED and the driving element increases, a stress of the OLED and the driving element increases. There is a difference in an amount of stress depending on a data voltage. The electrical characteristics of the driving element are affected by the stress. As a driving time of the pixels increases, the pixels are degraded. A reduction in image quality is visible on the screen due to a difference in degradation between the pixels. Thus, the OLED display compensates for degradation in driving characteristics of the pixels using an internal compensation method and an external compensation method, in order to compensate for the degradation in the driving characteristics of the pixels and make the driving characteristics of the pixels uniform.

The internal compensation method automatically compensates for a variation in a threshold voltage between the driving elements in a pixel circuit. In order to implement the internal compensation, the pixel additionally includes an internal compensation circuit, which compensates for a data voltage by threshold voltages of the OLED and the driving element inside the pixel so that a current flowing in the OLED is not affected by the threshold voltages of the OLED and the driving element.

The external compensation method senses the driving characteristics (including the threshold voltage, mobility, etc.) of the pixel and modulates pixel data of an input image based on the sensing result by a compensation circuit outside a display panel, thereby compensating for change in driving characteristics of each pixel.

More specifically, the external compensation method senses a voltage or a current of the pixel through a sensing circuit connected to the pixels of the display panel, converts the sensing result into digital data using an analog-to-digital converter (ADC), and transmits the digital data to a timing controller. The timing controller modulates digital video data of the input image based on the result of sensing the pixel and compensates for change in the driving characteristics of each pixel.

In the following description, example embodiments illustrate a pixel circuit connected to a sensing circuit for external compensation, by way of example. However, embodiments are not limited thereto. For example, the pixel circuit according to example embodiments may further include an internal compensation circuit.

Reference will now be made in detail to example embodiments, examples of which are illustrated in the accompanying drawings. However, the present disclosure is not limited to embodiments disclosed below, and may be implemented in various forms. These embodiments are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing embodiments of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the invention have been omitted.

In the present disclosure, when the terms "include", "have", "comprised of", etc. are used, other components may be added unless "~ only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present invention.

The features of various embodiments of the present disclosure can be partially combined or entirely combined with each other, and can be technically interlocking-driven in various ways. The embodiments can be independently implemented, or can be implemented in conjunction with each other.

In the following description, an algorithm means a data operation processing method of modulating pixel data using a previously set operation method, in order to improve image quality, power consumption, and life span. A compensation value used in the algorithm or obtained through the calculation of the algorithm is multiplied by or added to the pixel data. The compensation value for each timing controller may be changed depending on an image and external conditions, resulting in a luminance variation at an boundary surface. In embodiments of the disclosure, the compensation value includes a gain, an offset, and the like.

Various embodiments of the disclosure are described below with reference to FIGS. 1 to 17.

Figure 2:
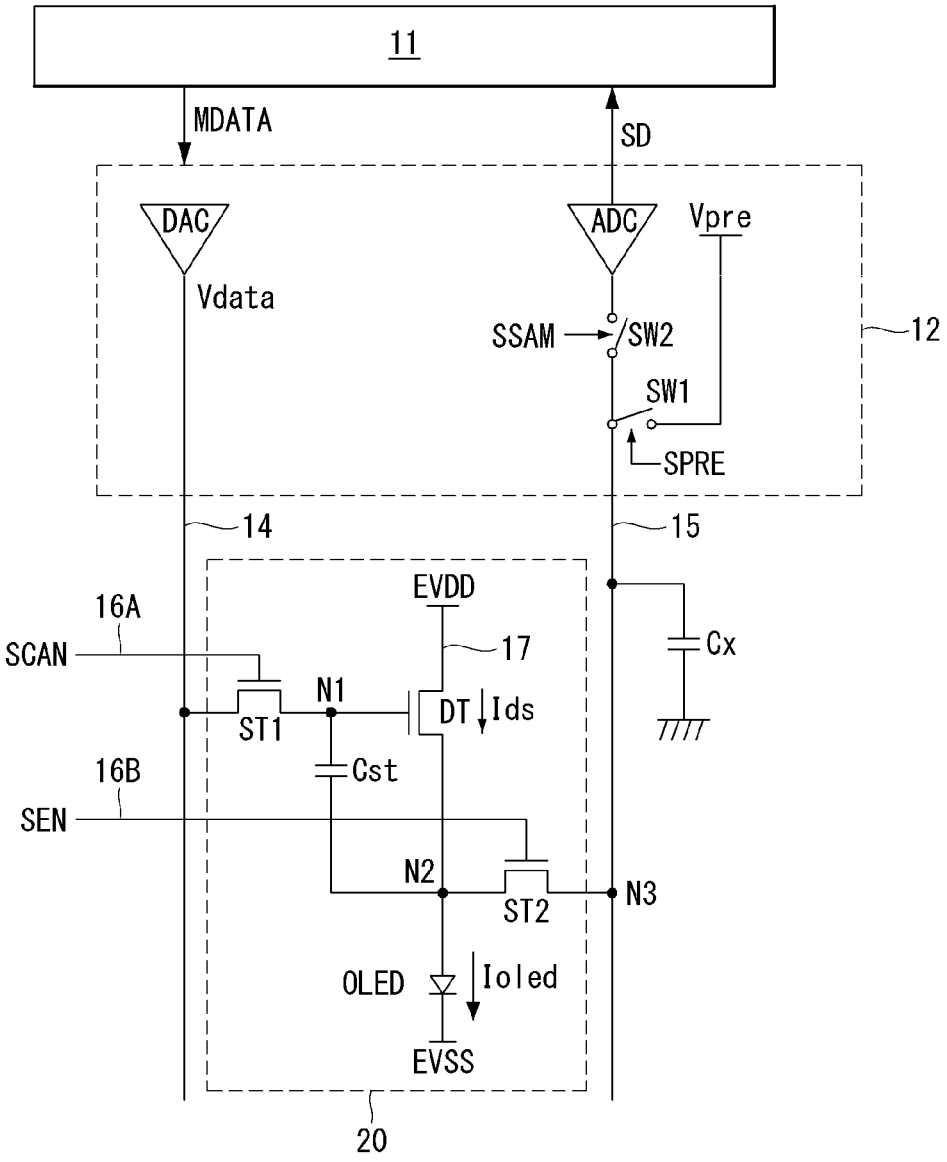
FIG. 2 illustrates in detail a connection structure between a timing controller, a data driver, and a pixel.

Referring to FIGS. 1 and 2, an electroluminescent display according to an example embodiment includes an active area 10 in which pixels P are arranged in a matrix, and a display panel driving circuit for writing pixel data of an input image to the pixels P of the active area 10.

In the active area 10, a plurality of data lines 14 and a plurality of gate lines 16 intersect each other, and the pixels P are arranged in the matrix. The active area 10 further includes sensing lines 15, power lines 17 for supplying a high potential pixel driving power voltage EVDD, electrodes for supplying a low potential power voltage EVSS, and the like. A reference voltage Vpre is supplied to the pixels P through the sensing lines 15.

The pixels P may include red (R), green (G), and blue (B) subpixels for color representation. In addition, the pixels P may further include white (W) subpixels. Each subpixel may include a pixel circuit 20 shown in FIG. 2. FIG. 2 illustrates an example of the pixel circuit. However, embodiments are not limited to the pixel circuit 20 shown in FIG. 2.

Each subpixel receives the high potential pixel driving power voltage EVDD and the low potential power voltage EVSS from a power circuit. Each subpixel may include an OLED, a driving TFT, first and second switching TFTs, a storage capacitor Cst, and the like. The TFTs constituting the subpixel may be implemented as p-type or n-type metal-oxide semiconductor field effect transistors (MOSFETs). Further, semiconductor layers of the TFTs may include amorphous silicon, polycrystalline silicon, or silicon oxide.

Each subpixel is connected to one of the data lines 14, one of the sensing lines 15, a first gate line 16A, and a second gate line 16B.

The display panel driving circuit includes a data driver 12 supplying data signals to the data lines 14, a gate driver 13 sequentially supplying gate pulses (or referred to as "scan pulses") synchronized with the data signals to the gate lines (or referred to as "scan lines") 16, and a timing controller 11 for controlling the data driver 12 and the gate driver 13.

During the image display period, the gate driver 13 sequentially supplies image display scan pulses to the gate lines 16 under the control of the timing controller 11. During the vertical blanking interval, the gate driver 13 supplies sensing scan pulses to the gate lines 16 connected to the pixels P of the sensing target line.

The image display scan pulses include first image display scan pulses SCAN sequentially supplied to the first gate lines 16A and second image display scan pulses SEN sequentially supplied to the second gate lines 16B. The sensing scan pulses include first sensing scan pulses SCAN supplied to the first gate lines 16A connected to the pixels P of the sensing target line and second sensing scan pulses SEN supplied to the second gate lines 16B connected to the pixels P of the sensing target line. The gate driver 13 may be formed on a substrate of a display panel together with a thin film transistor (TFT) array of the active area 10.

The data driver 12 supplies a data voltage Vdata to the data lines 14 and supplies the reference voltage Vpre to the sensing lines 15 under the control of the timing controller 11. The data driver 12 converts a sensing voltage received from the pixels P through the sensing lines 15 into digital data through an analog-to-digital converter (ADC), outputs sensing data SD, and transmits the sensing data SD to the timing controller 11. The data voltage Vdata may be divided into an image display data voltage, a sensing data voltage, and the like. However, embodiments are not limited thereto.

The data driver 12 supplies the image display data voltage of the input image to the data lines 14 in synchronization with the image display scan pulse and supplies the sensing data voltage to the data lines 14 in synchronization with the sensing scan pulse. The image display data voltage indicates a data voltage, in which a compensation value for compensating for change in driving characteristics of the pixel based on a result of sensing the driving characteristics of the pixel is reflected. The compensation value may include an offset value and a gain value, but is not limited thereto. The data driver 12 includes source driver integrated circuits (ICs) and may be connected to the data lines 14.

The timing controller 11 generates timing control signals SDC and GDC for controlling operation timings of the data driver 12, the gate driver 13, and a sensing circuit based on timing signals, such as a vertical sync signal Vsync, a horizontal sync signal Hsync, a main clock MCLK, and a data enable signal DE. As shown in FIG. 2, the sensing circuit includes the sensing line 15, a sensing capacitor Cx, switching elements SW1 and SW2, an ADC, and the like. The timing controller 11 modulates image display digital data to be supplied to the pixel using the compensation value during the image display period, in order to compensate for change in driving characteristics of the pixel based on the sensing data SD received from the data driver 12. In FIG. 2, "MDATA" indicates image display data that is modulated by the timing controller 11 and is transmitted to the data driver 12.

The timing controller 11 may modulate the pixel data of the input image using the compensation value obtained through various image improvement algorithms as well as an external compensation algorithm. Image quality improvement related information from the timing controller 11 may be transmitted to a bridge IC to be described later, integrally managed, and transmitted to another timing controller.

In an example illustrated in FIG. 2, the pixel circuit 20 includes an OLED, a driving TFT DT, a storage capacitor Cst, a first switching TFT ST1, and a second switching TFT ST2.

The OLED includes an anode, a cathode, and an organic compound layer between the anode and the cathode. The organic compound layer may include a hole injection layer HIL, a hole transport layer HTL, an emission layer EML, an electron transport layer ETL, and an electron injection layer EIL, but is not limited thereto. The OLED emits light due to excitons generated by holes and electrons moving to the emission layer EML when a voltage equal to or greater than a threshold voltage of the OLED is applied between the anode and the cathode.

The driving TFT DT includes a gate electrode connected to a first node N1, a drain electrode connected to an input terminal of the high potential pixel driving power voltage EVDD, and a source electrode connected to a second node N2. The driving TFT DT controls a driving current Ioled flowing in the OLED depending on a gate-to-source voltage Vgs of the driving TFT DT. The driving TFT DT is turned on when the gate-to-source voltage Vgs is greater than a threshold voltage Vth. As the gate-to-source voltage Vgs increases, a current Ids flowing between the source electrode and the drain electrode of the driving TFT DT increases. When a source voltage of the driving TFT DT is greater than the threshold voltage of the OLED, the source-to-drain current Ids of the driving TFT DT, as the driving current Ioled of the OLED, flows through the OLED. As the driving current Ioled increases, an amount of light emitted by OLED increases. Hence, a descried gray scale is represented.

The storage capacitor Cst is connected between the first node N1 and the second node N2.

The first switching TFT ST1 includes a gate electrode connected to the first gate line 16A, a drain electrode connected to the data line 14, and a source electrode connected to the first node N1. The first switching TFT ST1 is turned on in response to the first scan pulse SCAN and applies the data voltage Vdata charged to the data line 14 to the first node N1.

The second switching TFT ST2 includes a gate electrode connected to the second gate line 16B, a drain electrode connected to the second node N2, and a source electrode connected to the sensing line 15. The second switching TFT ST2 is turned on in response to the second scan pulse SEN and electrically connects the second node N2 to the sensing line 15.

The data driver 12 is connected to the pixels P through the data lines 14 and the sensing lines 15. The data driver 12 includes a digital-to-analog converter (DAC), an ADC, an initialization switch SW1, a sampling switch SW2, and the like. The sensing capacitor Cx, that samples and stores a source voltage of the second node N2, is connected to the sensing line 15.

The DAC receives digital data and generates the data voltage Vdata (i.e., the image display data voltage and the sensing data voltage) required for a drive operation, and the luminance compensation data voltage. The DAC outputs the data voltage Vdata to the data line 14.

The sensing capacitor Cx may be provided as a separate capacitor or implemented as a parasitic capacitor connected to the sensing line 15. Charges from the pixels P are stored in the sensing capacitor Cx.

The initialization switch SW1 is turned on in response to an initialization control signal SPRE and outputs the reference voltage Vpre to the sensing line 15. The sampling switch SW2 is turned on in response to a sampling control signal SSAM and supplies the ADC with a sensing voltage, which is stored in the sensing capacitor Cx of the sensing line 15 for a predetermined time. The ADC converts the sensing voltage sampled by the sensing capacitor Cx into digital data and supplies the digital data to the timing controller 11.

Figure 3:
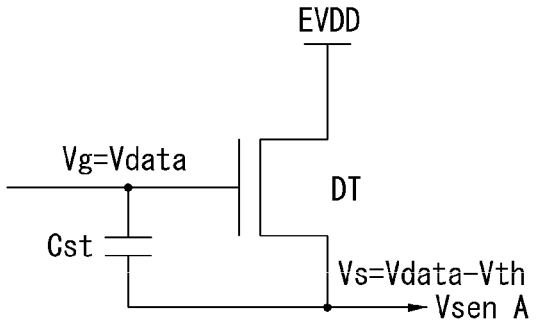
FIGS. 3 and 4 illustrate a principle of a method of sensing driving characteristics of a pixel.
Figure 3:
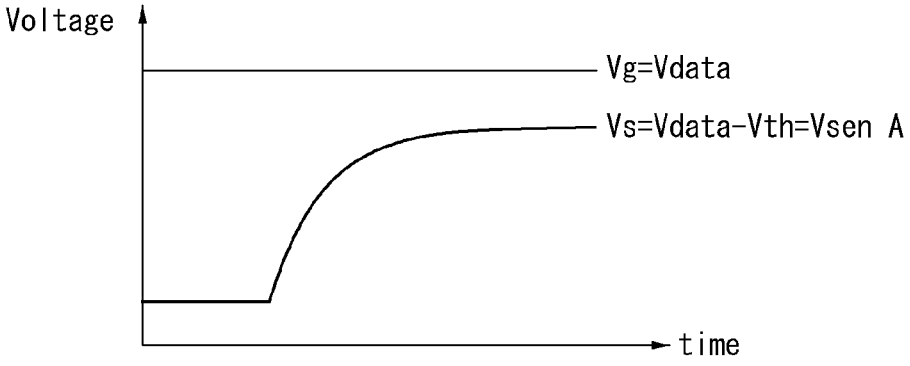
Figure 4:
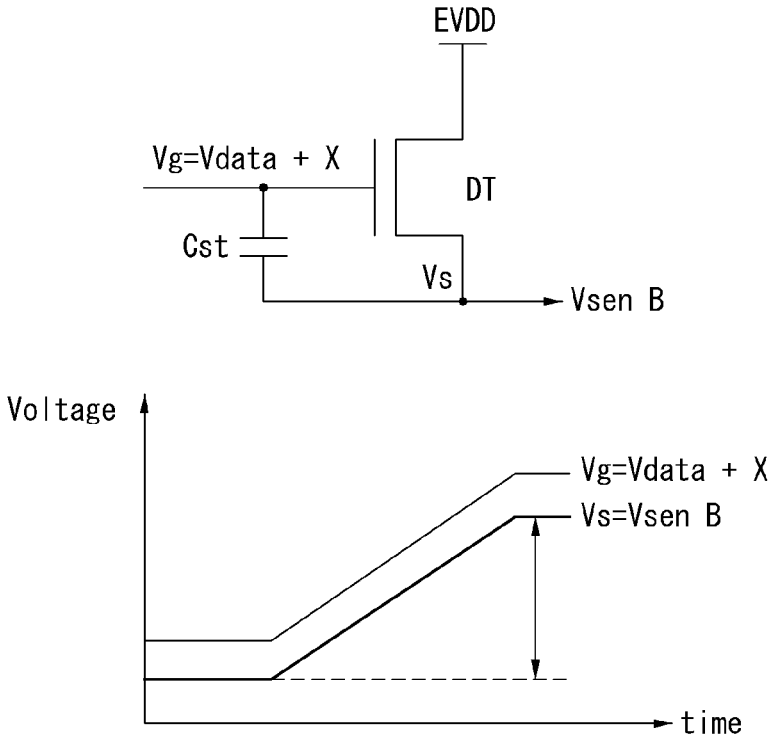

FIGS. 3 and 4 schematically illustrate a principle of a method of sensing driving characteristics (e.g., driving characteristics of a driving TFT) of a pixel. More specifically, FIG. 3 illustrates a method (hereinafter, referred to as "first sensing method") of sensing a threshold voltage of a driving TFT, and FIG. 4 illustrates a method (hereinafter, referred to as "second sensing method") of sensing mobility of a driving TFT.

Referring to FIG. 3, the first sensing method supplies a sensing data voltage Vdata to a gate of a driving TFT DT, operates the driving TFT DT using a source follower method, receives a source voltage Vs of the driving TFT DT as a sensing voltage Vsen A, and senses a threshold voltage Vth of the driving TFT DT based on the sensing voltage Vsen A. A capacitor Cst storing a gate-to-source voltage Vgs of the driving TFT DT is connected between the gate and a source of the driving TFT DT. The source voltage Vs of the driving TFT DT is expressed as follows: Vs=Vdata−Vth=Vsen A. The threshold voltage Vth of the driving TFT DT may be determined depending on a level of the sensing voltage Vsen A, and an offset value for compensating for change in the threshold voltage Vth of the driving TFT DT may be determined. The change in the threshold voltage Vth of the driving TFT DT can be compensated by adding the offset value to data of an input image. In the first sensing method, the threshold voltage Vth of the driving TFT DT has to be sensed after the gate-to-source voltage Vgs of the driving TFT DT operating as a source follower reaches a saturation state. Therefore, a relatively long time is required to sense the driving TFT DT. When the gate-to-source voltage Vgs of the driving TFT DT is saturated, a drain-to-source current of the driving TFT DT is zero.

Referring to FIG. 4, the second sensing method senses mobility μ of a driving TFT DT. The second sensing method applies a voltage Vdata+X greater than a threshold voltage of the driving TFT DT to a gate of the driving TFT DT to turn on the driving TFT DT, and receives a source voltage Vs of the driving TFT DT charged for a predetermined time as a sensing voltage Vsen B, where X is a voltage obtained according to the compensation using an offset value. The mobility of the driving TFT DT is determined depending on a magnitude of the sensing voltage Vsen B, and a gain value for data compensation is obtained based on a result of sensing the mobility. The second sensing method senses the mobility of the driving TFT DT when the driving TFT DT operates in an active region. In the active region, the source voltage Vs of the driving TFT DT rises along its gate voltage Vg. Change in the mobility of the driving TFT DT can be compensated by multiplying data of an input image by the gain value. The second sensing method can reduce time required in the sensing because the mobility of the driving TFT DT is sensed in the active region of the driving TFT DT.

The external compensation method according to the embodiment can sense and compensate for the mobility of each pixel for a predetermined time (e.g., within several seconds) in a power-on sequence in which power starts to be input to the electroluminescent display. The external compensation method senses and compensates for the mobility of the pixels at a high speed, in order to exclude a variation in the driving characteristics between the pixels depending on an ambient temperature environment in the power-on sequence. The external compensation method according to the embodiment can sense and compensate for the threshold voltage of the driving TFT included in each of the more degraded pixels for a predetermined time (e.g., within several minutes) in a power-off sequence in which the electroluminescent display is powered down and turned off.

Pixel data of an input image is written to the pixels after the power-on sequence, and the input image is displayed on the active area 10. The power supply to the display panel driving circuit is cut off in the power-off sequence, and thus the pixels are not supplied with new data and are turned off.

A plurality of display lines, on which the pixels P are arranged in a line direction (for example, X-axis direction), are formed in the active area 10. The display lines of the active area 10 display data of an input image during an image display period of one frame period. During a vertical blanking interval excluding the image display period from one frame period, driving characteristics of pixels arranged on a line (hereinafter referred to as "sensing target line") to be sensed may be sensed and compensated in real time. During a vertical blanking interval of a next frame period, driving characteristics of pixels on another sensing target line may be sensed and compensated in real time. Thus, the sensing circuit shifts the display line by one line in a vertical blanking interval of each frame period and can sense and compensate for driving characteristics of the pixels on the display lines of the active area 10 in real time. The precision of a sensing waveform and the synchronization of data outputs are very important in the external compensation, and the normal sensing and compensation can be performed by matching the synchronization through the bridge IC 200.

Figure 5:
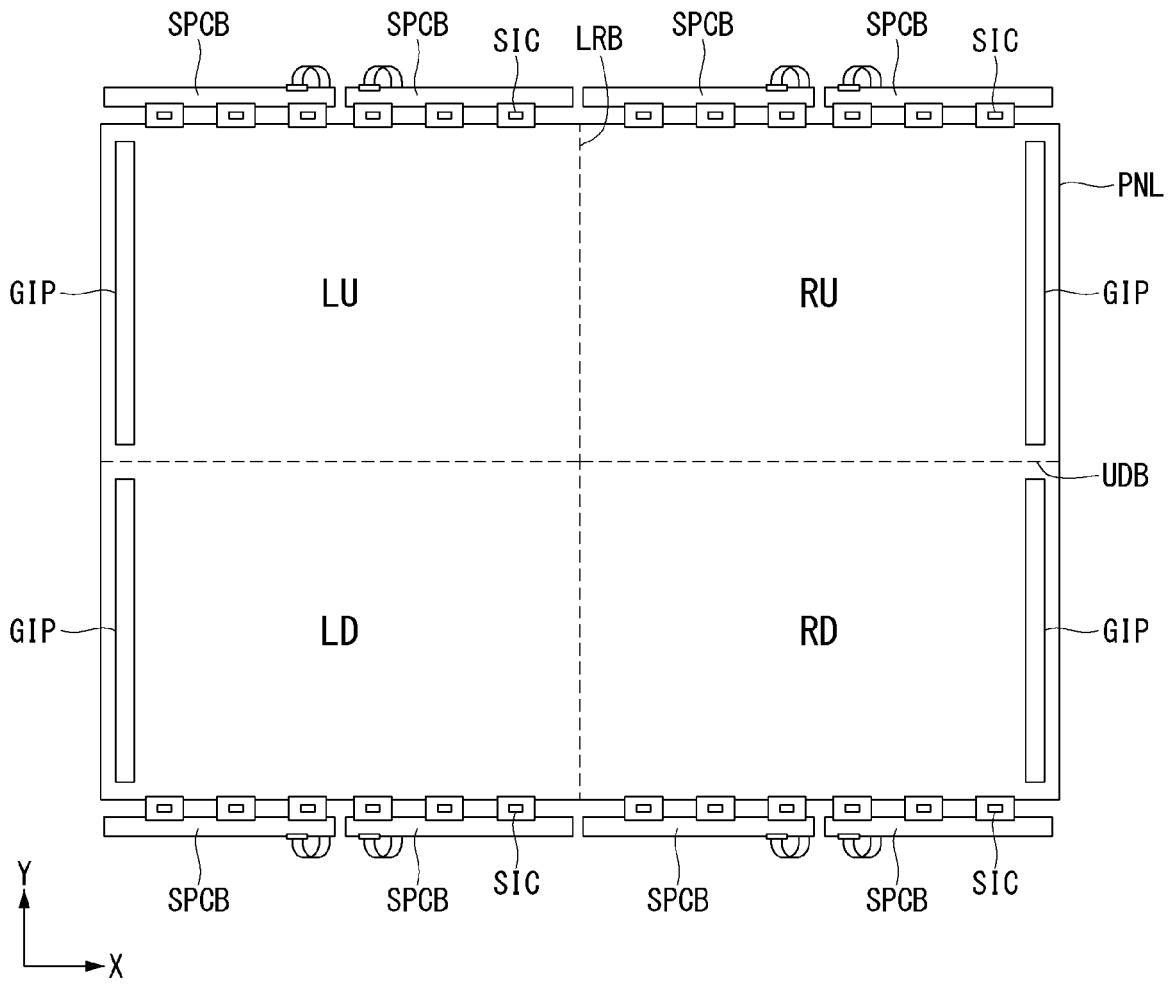
FIG. 5 is a front view of an electroluminescent display according to an example embodiment when viewed from the front.

As shown in FIG. 5, the embodiment implements a high-resolution and large-screen display device by combining at least two active areas and at least two display panel driving circuits on one display panel substrate.

Figure 6:
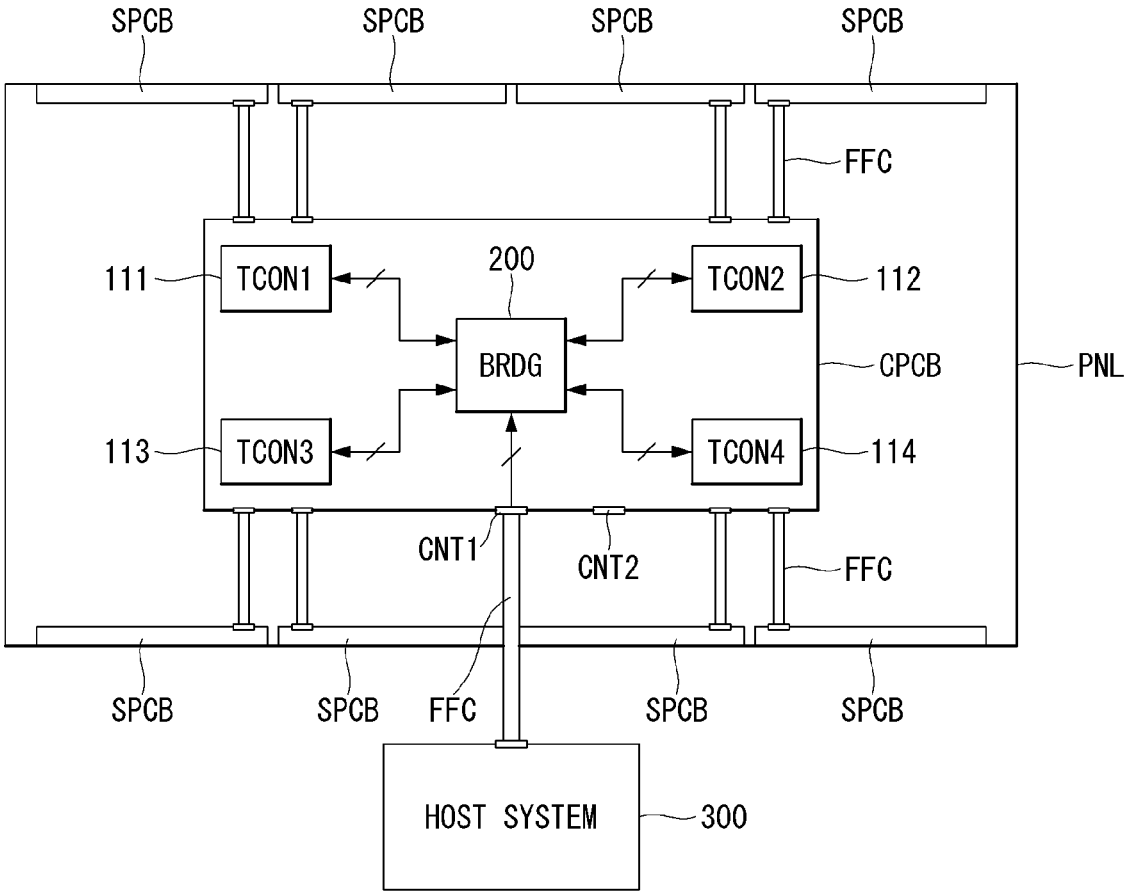
FIG. 6 is a rear view of a display device shown in FIG. 5 when viewed from the rear.
Figure 7:
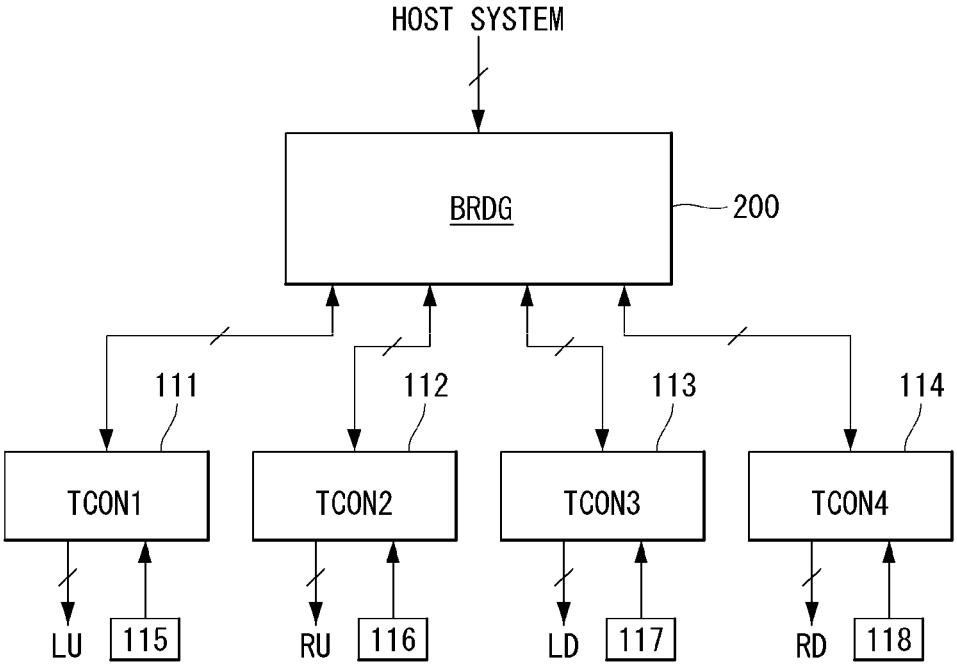
FIG. 7 illustrates a bridge integrated circuit (IC) and timing controllers.
Figure 8:
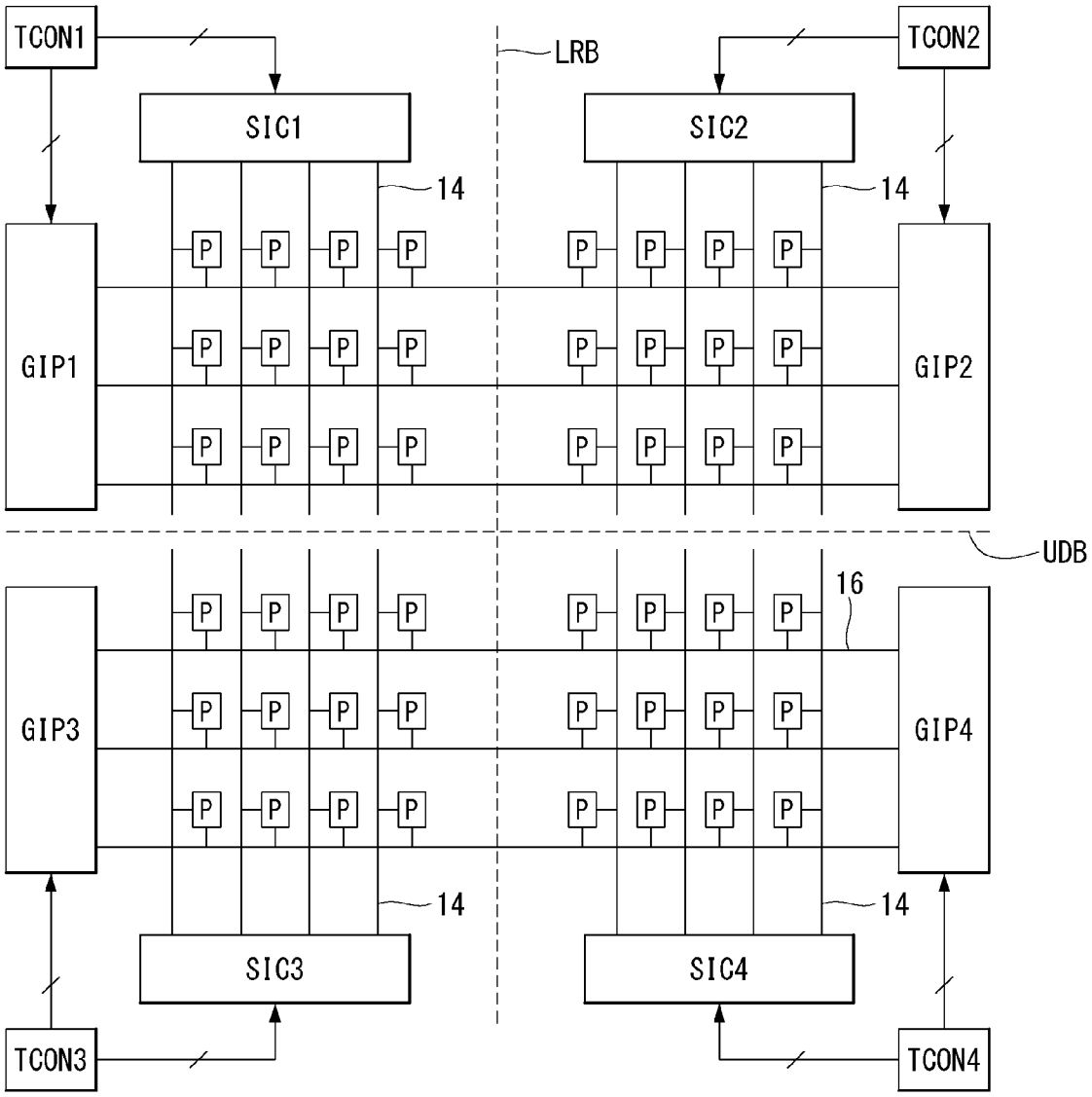
FIG. 8 schematically illustrates lines connected to pixels in an intersection portion of boundary lines on a display panel shown in FIG. 5.

FIG. 5 is a front view of an electroluminescent display according to an example embodiment when viewed from the front. FIG. 6 is a rear view of a display device shown in FIG. 5 when viewed from the rear. FIG. 7 illustrates a bridge IC and timing controllers. FIG. 8 schematically illustrates lines connected to pixels in an intersection portion of boundary lines on a display panel shown in FIG. 5.

Referring to FIGS. 5 to 8, an electroluminescent display according to an example embodiment includes a display panel PNL and a display panel driving circuit for writing data of an input image to the display panel PNL.

A screen of the display panel PNL is divided into four active areas. A first active area LU is disposed in an upper left half portion of the screen and controlled by a first timing controller 111 (or denoted by TCON1). A second active area RU is disposed in an upper right half portion of the screen and controlled by a second timing controller 112 (or denoted by TCON2). A third active area LD is disposed in a lower left half portion of the screen and controlled by a third timing controller 113 (or denoted by TCON3). A fourth active area RD is disposed in a lower right half portion of the screen and controlled by a fourth timing controller 114 (or denoted by TCON4).

The data driver 12 includes source driver ICs SIC and may be connected to the data lines 14 and the sensing lines 15. The gate driver 13 may be directly formed on a substrate of the display panel PNL. In FIG. 5, "GIP (gate-in panel)" denotes the gate driver 13 directly formed on the substrate of the display panel PNL.

In FIG. 5, "LRB" denotes a first boundary line between the left active areas LU and LD and the right active areas RU and RD, and "UDB" denotes a second boundary line between the upper active areas LU and RU and the lower active areas LD and RD. The boundary lines LRB and UDB do not indicate that the substrate of the display panel PNL is physically divided, but are boundary lines indicating that the substrate of the display panel PNL is controlled by the different timing controllers 111 to 114.

A chip on film (COF), on which the source driver ICs SIC are mounted, is connected between the display panel PNL and a source printed circuit board (PCB). Gate timing control signals for controlling the gate drivers GIP and a gate driving voltage may be transmitted to the gate drivers GIP on the display panel PNL through the COF.

The timing controllers 111 to 114 may be mounted on a control board CPCB together with a bridge IC 200. In FIG. 6, "BRDG" denotes the bridge IC 200. The timing controllers 111 to 114 may be implemented as an application-specific integrated circuit (ASIC), and the bridge IC 200 may be implemented as a field programmable gate array (FPGA). However, embodiments are not limited thereto.

When power is input to the electroluminescent display, the timing controllers 111 to 114 each load a parameter from flash memories 115 to 118, a compensation value (e.g., a gain value and an offset value) for the external compensation, and a grayscale-luminance-voltage-current table to an internal memory SRAM. The bridge IC 200 reads the parameter from each of the timing controllers 111 to 114 and determines the function setting of each of the timing controllers 111 to 114. The bridge IC 200 reads the parameters and determines a processing method of 8K image mode, an amount of data to be transmitted and received, a delay time until a synchronization completion signal is generated after the synchronization matching, and the like. The bridge IC 200 integrally manages the compensation values for the external compensation and the grayscale-luminance-voltage-current tables received from the timing controllers 111 to 114 and integrally corrects the image processing results performed by the timing controllers 111 to 114 using the grayscale-luminance-voltage-current tables to transmit the same operation value to the timing controllers 111 to 114. Hence, the bridge IC 200 corrects a variation of the image processing result values resulting from the input image and the table.

The grayscale-luminance-voltage-current table is made based on a result of measuring a luminance at each gray level before shipment of the product and is stored in the flash memories 115 to 118. The bridge IC 200 modulates gray levels of pixel data of an input image using a predetermined algorithm and transmits the modulated gray levels to the source driver ICs SIC, in order to improve image quality of the input image based on the grayscale-luminance-voltage-current table. The bridge IC 200 stores a driving history of each pixel using the grayscale-luminance-voltage-current table and may modulate the pixel data using the driving history of each pixel, in order to reduce a luminance of the pixel when an overcurrent flows in the pixel. The bridge IC 200 receives a high resolution input image from a main board of a host system 300, divides the input image into the active areas LU, RU, LD and RD, performs an algorithm for image quality improvement to modulate pixel data of the input image, and distributes the modulated pixel data to the timing controllers 111 to 114.

The main board of the host system 300 includes a user input device for receiving a user command, a communication module for communicating with a peripheral device, a communication module connected to a communication network such as Internet, a graphic processing module connected to an electroluminescent display, and the like. The main board is connected to a power supply that generates electric power. The power supply supplies electric power from a commercial AC power source or a battery to the main board and the display panel driving circuit. The host system 300 may be a system requiring a display device such as a television system and a computer system. The host system 300 may transmit a video signal of the input image to the bridge IC 200 through a high-speed transmission interface, for example, trade name "V-by-one interface".

Figure 13:
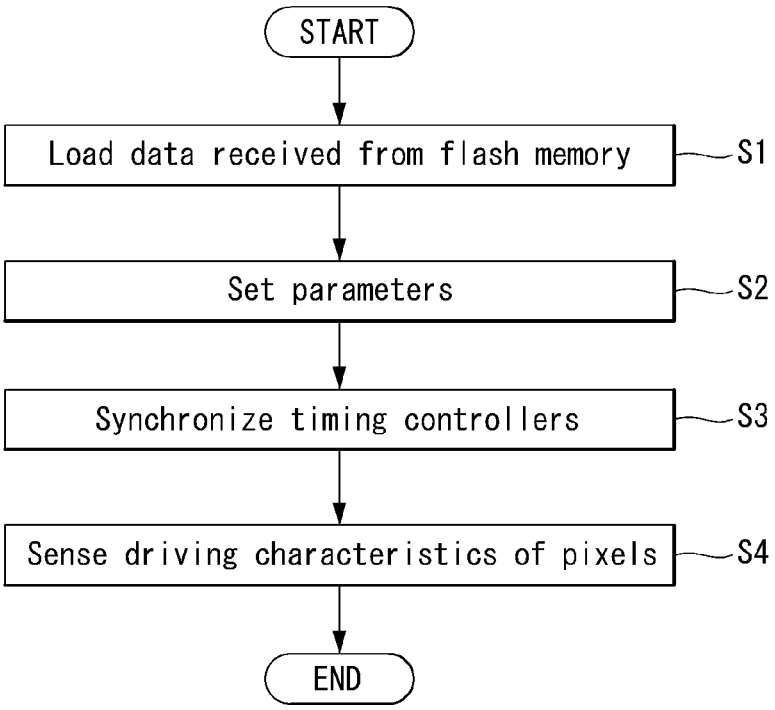
FIG. 13 is a flow chart illustrating a real-time sensing method according to an example embodiment.

The bridge IC 200 transmits a command to the timing controllers 111 to 114 in accordance with a sequence that is previously set in the timing controllers 111 to 114. For example, the bridge IC 200 transmits a data request command to the timing controllers 111 to 114 and transmits a sensing start command to the timing controllers 111 to 114 when driving characteristics of the pixel for external compensation are sensed. The bridge IC 200 performs synchronization matching between the timing controllers 111 to 114 when the synchronization between the timing controllers 111 to 114 is necessary (for example, when driving characteristics of the pixels are sensed as shown in FIG. 13). The bridge IC 200 and the timing controllers 111 to 114 perform data communication using a transistor-transistor logic (TTL) signal.

A level shifter, a power management integrated circuit (PMIC), etc. may be mounted on the control board CPCB. The PMIC receives a DC input voltage using a DC-DC converter and outputs various DC voltages, for example, the voltages Vpre, EVDD, EVSS, VGH, VGL, and a gamma reference voltage required to drive the display panel PNL.

The level shifter shifts a voltage level of the gate timing control signal received from the timing controllers 111 to 114, converts the voltage level of the gate timing control signal into a voltage swinging between a gate high voltage VGH and a gate low voltage VGL, and supplies the gate timing control signal to the gate driver GIP. The gate driver GIP outputs the scan pulse in response to the gate timing control signal received from the timing controllers 111 to 114 through the level shifter. The scan pulse output from the gate driver GIP swings between the gate high voltage VGH and the gate low voltage VGL. The gate high voltage VGH is a gate-on voltage capable of turning on the switching TFT of the pixel circuit, and the gate low voltage VGL is a gate-off voltage capable of turning off the switching TFT of the pixel circuit.

Each of the timing controllers 111 to 114 transmits the pixel data of the input image received from the bridge IC 200 to the source driver IC SIC taken charge of by each timing controller. Further, the timing controllers 111 to 114 transmit control data, clocks, etc. together with the pixel data of the input image to the source driver ICs SIC.

Each of the timing controllers 111 to 114 extracts timing signals, such as a vertical sync signal, a horizontal sync signal, a main clock, and a data enable signal, from an input image signal received through the bridge IC 200. Each of the timing controllers 111 to 114 generates timing control signals for controlling operation timings of the source driver IC SIC and the gate driver GIP using the timing signals. Each of the timing controllers 111 to 114 multiplies an input frame frequency of the input image signal by N and can control the source driver IC SIC and the gate driver GIP based on the input frame frequency, where N is a positive integer equal to or greater than 2. The input frame frequency is 50 Hz in a phase alternate line (PAL) method and is 60 Hz in a national television standards committee (NTSC) method.

The control board CPCB may be connected to a source PCB SPCB through a flexible flat cable (FFC) and connected to the main board of the host system 300 through the FFC.

The control board CPCB includes connectors connected to the flexible flat cables. The connectors include a plurality of connectors for connecting the control board CPCB to the source PCB SPCB, a connector CNT1 for connecting the control board CPCB to the host system 300, and a connector CNT2 for connecting the control board CPCB to a computer before shipment of the product.

The computer connected to the control board CPCB before shipment of the product makes the grayscale-luminance-voltage-current table based an experiment for measuring a luminance at each gray level and stores a compensation value for compensating for a variation in driving characteristics between the pixels in the flash memories 115 to 118. Further, the computer stores register setting values, parameters, etc. for the function setting of the timing controllers 111 to 114 in the flash memories 115 to 118. After shipment of the product, the computer is detached from the control board CPCB, and the connector CNT2 is not used.

The compensation value obtained based on a result of sensing the driving characteristics of the pixels in an aging process before shipment of the product is transmitted from the computer to the bridge IC 200 of the control board CPCB through a low voltage differential signaling (LVDS) interface. The grayscale-luminance-voltage-current table prepared based the experiment for measuring a luminance at each gray level before shipment of the product is transmitted from the computer to the bridge IC 200 of the control board CPCB through an $I^2C$ communication interface. The bridge IC 200 stores the compensation value of the pixels, the grayscale-luminance-voltage-current table, the register setting value, the parameter, etc. received from the computer in the flash memories 115 to 118 connected to the timing controllers 111 to 114. Each of the timing controllers 111 to 114 may be connected to the flash memory and an electrically erasable programmable read-only memory (EEPROM). In this instance, the bridge IC 200 may store the grayscale-luminance-voltage-current table, timing control signal information, etc. in the EEPROM through the $I^2C$ communication interface.

The gate lines 16 are disposed in the left and right active areas that are seamlessly adjacent to each other across the first boundary line LRB between the left active areas LU and LD and the right active areas RU and RD. As shown in FIG. 8, gate drivers GIP1 to GIP4 are connected to both sides of the gate lines 16. The gate drivers GIP1 to GIP4 simultaneously apply the scan pulses to both ends of the gate line 16 under the control of the timing controllers 111 to 114 and shift the scan pulse in response to a shift clock.

As shown in FIG. 8, the data lines 14 are separated at the second boundary line UDB between the upper active areas LU and RU and the lower active areas LD and RD. This is to reduce RC delay of the signals applied through the lines by reducing a RC load of the lines through a reduction in lengths of the data lines 14 and lengths of the sensing lines 15. The data lines 14 and the sensing lines 15 disposed in the upper half portion of the screen of the display panel PNL are connected to source driver ICs SIC1 and SIC2 taking charge of the upper active areas LU and RU. The data lines 14 and the sensing lines 15 disposed in the lower half portion of the screen of the display panel PNL are connected to source driver ICs SIC3 and SIC4 taking charge of the lower active areas LD and RD.

The first timing controller 111 transmits pixel data of the first active area LU received from the bridge IC 200 to the source driver IC SIC1 of first driving circuits SIC1 and GIP1. The first timing controller 111 controls operation timing of the first driving circuits SIC1 and GIP1 for driving the pixels of the first active area LU.

The second timing controller 112 transmits pixel data of the second active area RU received from the bridge IC 200 to the source driver IC SIC2 of second driving circuits SIC2 and GIP2. The second timing controller 112 controls operation timing of the second driving circuits SIC2 and GIP2 for driving the pixels of the second active area RU.

The third timing controller 113 transmits pixel data of the third active area LD received from the bridge IC 200 to the source driver IC SIC3 of third driving circuits SIC3 and GIP3. The third timing controller 113 controls operation timing of the third driving circuits SIC3 and GIP3 for driving the pixels of the third active area LD.

The fourth timing controller 114 transmits pixel data of the fourth active area RD received from the bridge IC 200 to the source driver IC SIC4 of fourth driving circuits SIC4 and GIP4. The fourth timing controller 114 controls operation timing of the fourth driving circuits SIC4 and GIP4 for driving the pixels of the fourth active area RD.

The timing controllers 111 to 114 may modulate the pixel data received from the bridge IC 200 using the compensation values loaded from the flash memories 115 to 118 and transmit the modulated pixel data to the source driver ICs SIC1 to SIC4, in order to compensate for the driving characteristic variations of the pixels and the degradation of the pixels.

Figure 9:
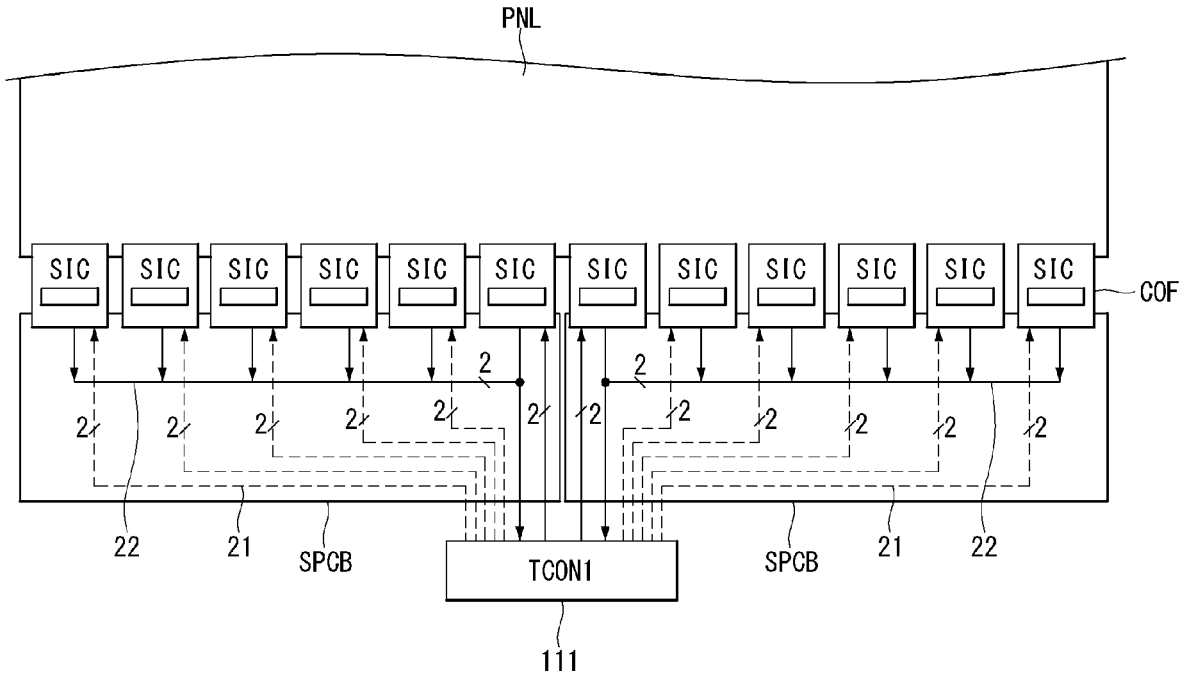
FIG. 9 illustrates in detail lines between a timing controller and source driver ICs.

FIG. 9 illustrates in detail the connection of lines between the first timing controller 111 and the source driver ICs SIC. The second to fourth timing controllers 112 to 114 are connected to the source driver ICs through the same method as FIG. 9.

Referring to FIG. 9, each of source driver ICs SIC receives digital data of an input image from the first timing controller 111 through a first pair 21 of the data lines and transmits sensing data to the first timing controller 111 through a second pair 22 of the data lines. The sensing data transmitted to the first timing controller 111 includes driving characteristic sensing information of the pixels obtained through the sensing circuit.

Figure 10:
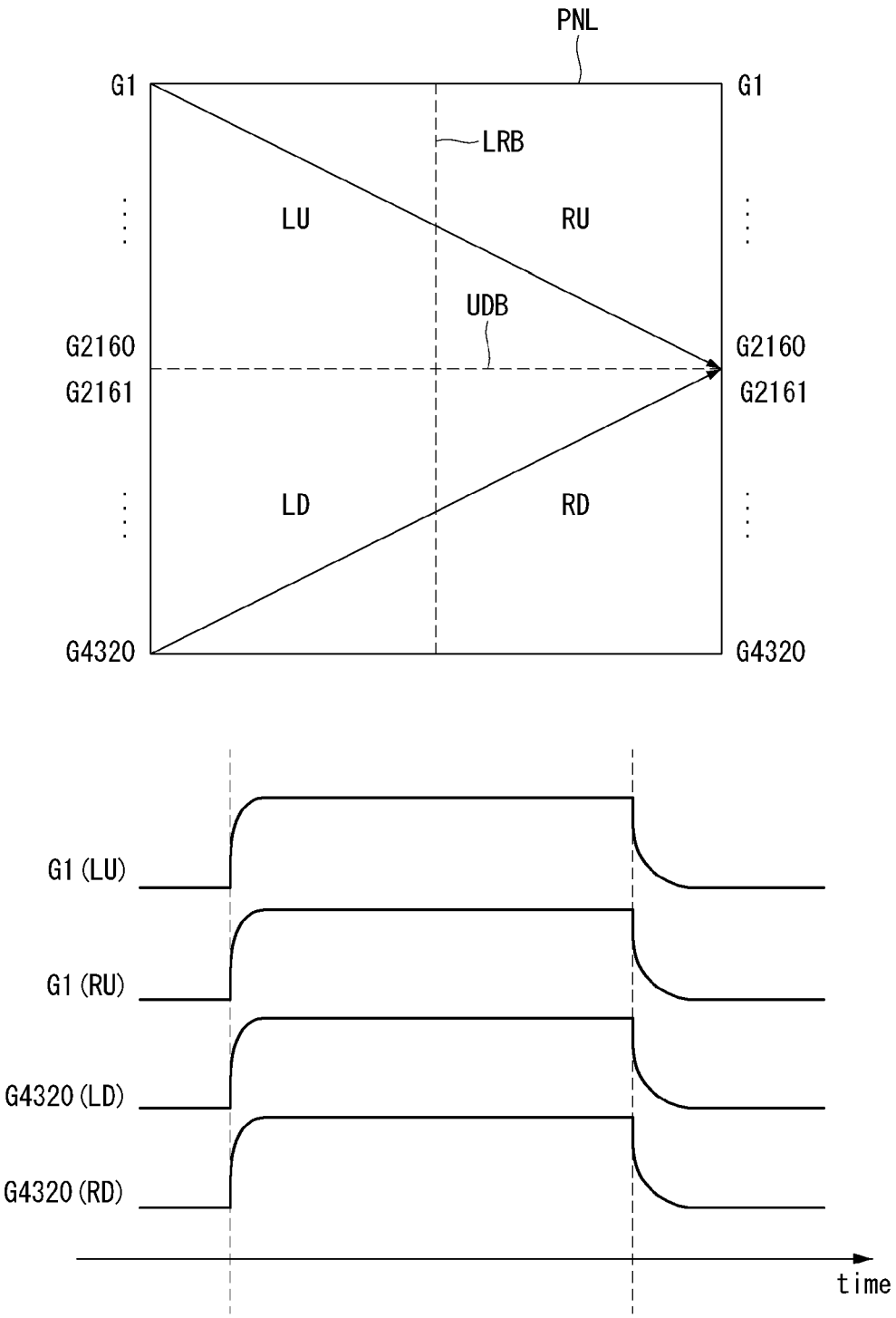
FIG. 10 illustrates first gate pulses synchronized in each of four divided active areas.
Figure 11:
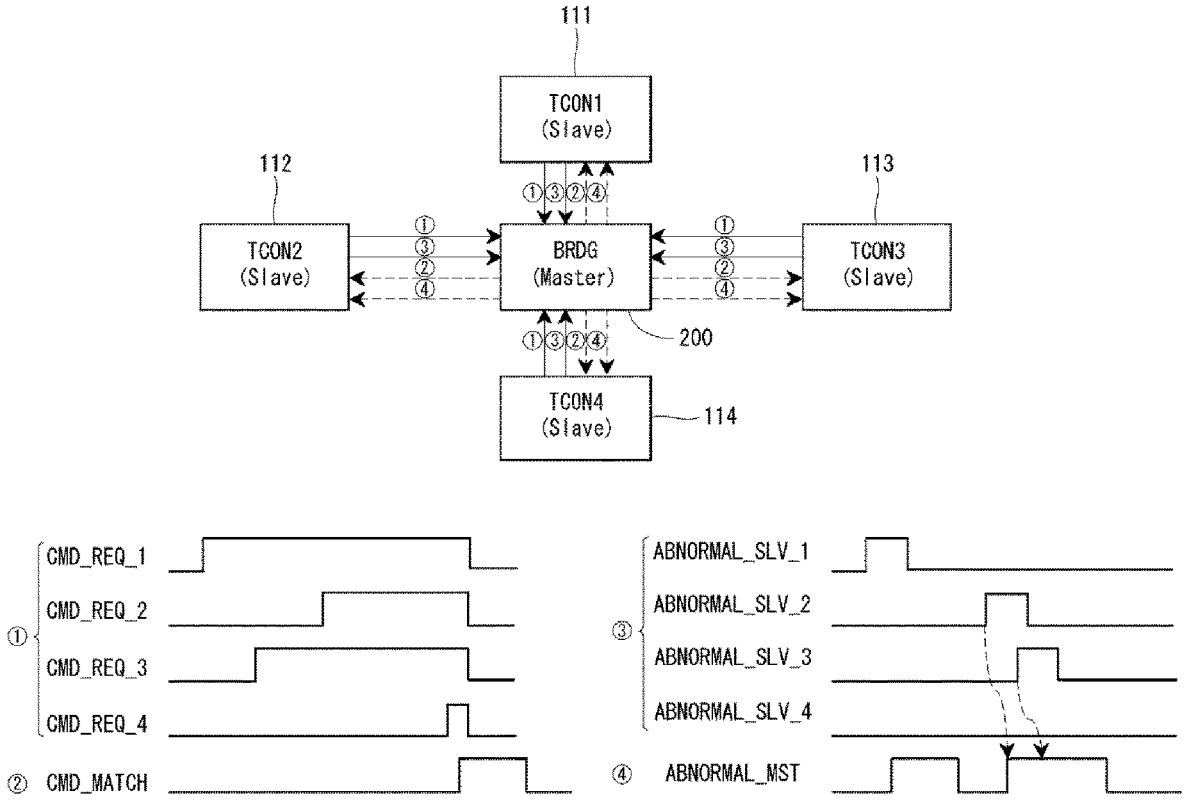
FIG. 11 illustrates a method of controlling synchronization between timing controllers.

FIG. 10 illustrates first gate pulses synchronized in each of four divided active areas. FIG. 11 illustrates a method of controlling the synchronization between timing controllers.

Figure 12:
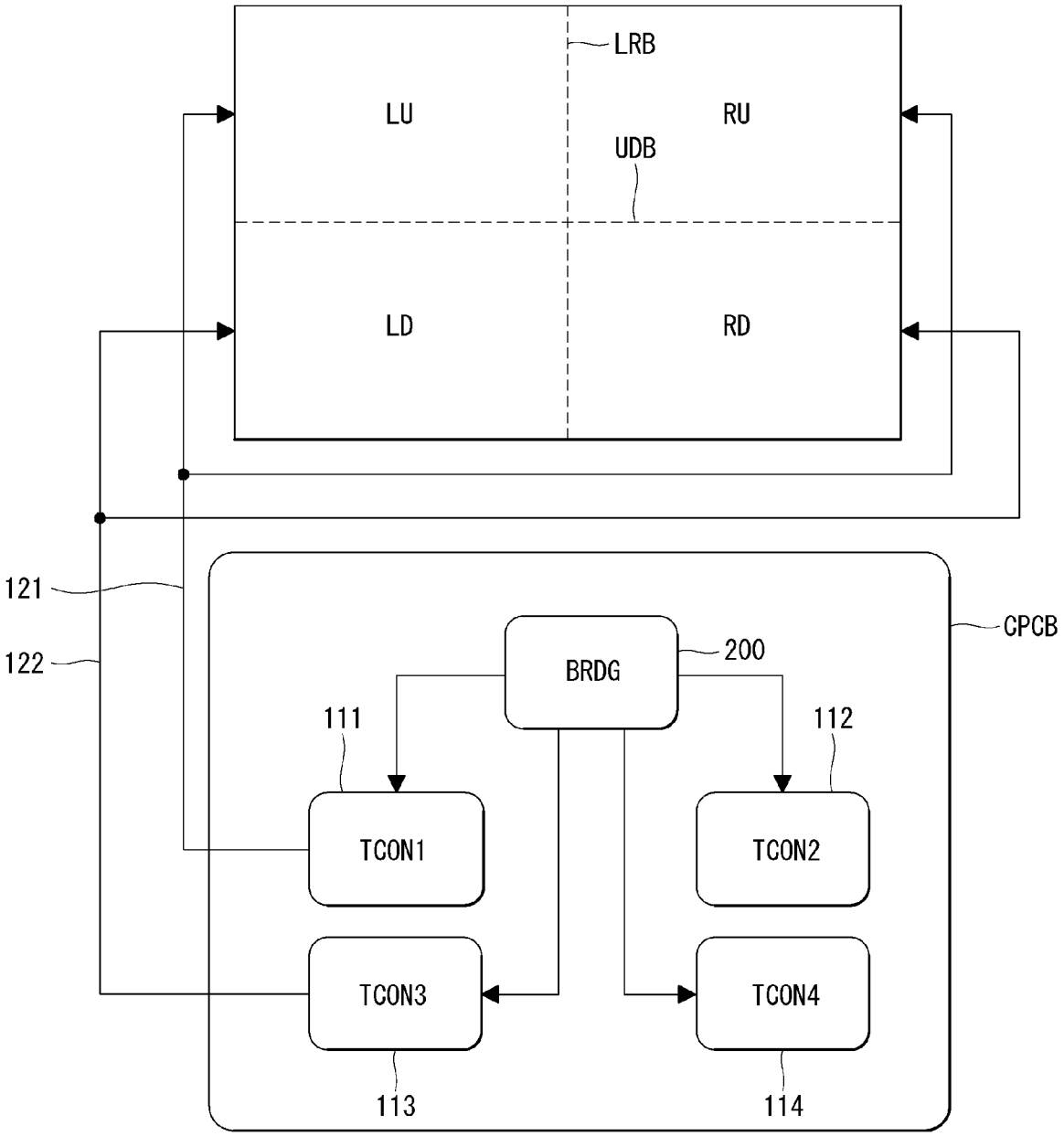
FIG. 12 illustrates an example where gate drivers of upper active areas are controlled by one timing controller and gate drivers of lower active areas are controlled by one timing controller.

Referring to FIG. 10, the first and second gate drivers GIP1 and GIP2 sequentially supply the scan pulses to gate lines G1 to G2160 of the upper active areas LU and RU in a forward sequence scanning method. The first and second gate drivers GIP1 and GIP2 may be dividedly controlled by the first and second timing controllers 111 and 112. Alternatively, as shown in FIG. 12, the first and second gate drivers GIP1 and GIP2 may be controlled by one of the first and second timing controllers 111 and 112 so that it is advantageous for synchronization between the first and second timing controllers 111 and 112. The scan pulse starts to be supplied to the first gate line G1 of the upper active areas LU and RU, and the scan pulses are sequentially supplied to the second to $2160^{th}$ gate lines G2 to G2160 underlying the first gate line G1 in the order named. The $2160^{th}$ gate line and the $2161^{th}$ gate line are adjacent to each other with the second boundary line UDB between the upper active areas LU and RU and the lower active areas LD and RD interposed therebetween.

The third and fourth gate drivers GIP3 and GIP4 sequentially supply the scan pulses to gate lines G2161 to G4320 of the lower active areas LD and RD in a reverse sequence scanning method. The third and fourth gate drivers GIP3 and GIP4 may be dividedly controlled by the third and fourth timing controllers 113 and 114. Alternatively, as shown in FIG. 12, the third and fourth gate drivers GIP3 and GIP4 may be controlled by one of the third and fourth timing controllers 113 and 114 so that it is advantageous for synchronization between the third and fourth timing controllers 113 and 114. The scan pulse starts to be supplied to the $4320^{th}$ gate line G4320 at the lowermost side of the lower active areas LD and RD, and the scan pulses are sequentially supplied to the $4319^{th}$ to $2161^{th}$ gate lines G4319 to G2161 on the $4320^{th}$ gate line G4320 in the order named.

The scan pulses have to be simultaneously applied to the pixels on one line, in order to sense the driving characteristics of the pixels. However, the synchronization cannot be completely matched due to a physical variation between the timing controllers 111 to 114. A spread spectrum clock generator (SSCG) is embedded in each of the timing controllers 111 to 114, in order to reduce electromagnetic interference (EMI). The timing controllers 111 to 114 sample data according to clock timing and generate timing control signals. The spread spectrum clock generator modulates a duty ratio, a cycle, etc. of clocks generated by the timing controllers 111 to 114 within an allowable range, thereby reducing the electromagnetic interference. Because the spread spectrum clock generators of the timing controllers 111 to 114 each have different clock modulation timing and a different clock modulation width, a timing variation may occur between gate timing signals output from the timing controllers 111 to 114. When the gate timing control signals output from the timing controllers 111 to 114 are not completely synchronized, the outputs of the gate drivers GIP1 to GIP4 connected to both sides of the gate lines 16 are not synchronized. In this instance, the driving characteristics of the pixels may be inaccurately sensed, and a sensing time of the pixels may vary from line to line. Therefore, the accurate sensing is impossible. Further, if the outputs of the gate drivers GIP1 to GIP4 connected to both sides of the gate lines 16 are not synchronized even when the pixel data of the input image is written to the pixels, the driving timings of the pixels may vary from line to line. Therefore, the image quality between the left and right active areas may be reduced as a boundary line is seen between the left and right active areas.

The embodiment synchronizes the timing controllers 111 to 114 via a communication interface (for example, a serial interface) between the bridge IC 200 and the timing controllers 111 to 114, in order to enable the pixels to perform a sensing operation and a normal driving operation. In FIG. 10, G1(LU), G1(RU), G4320(LD), and G4320(RD) denote first scan pulses synchronized in the upper active areas LU and RU and the lower active areas LD and RD. The first scan pulses G1(LU) and G1(RU) are supplied to the first gate line G1 disposed at an uppermost side of the upper active areas LU and RU, and at the same time the first scan pulses G4320(LD) and G4320(RD) are supplied to the $4320^{th}$ gate line G4320 disposed at a lowermost side of the lower active areas LD and RD.

In a communication method for the synchronization matching, the bridge IC 200 operations as a master element, and the timing controllers 111 to 114 each operation as a slave element. As indicated by ① in FIG. 11, when the synchronization between the timing controllers 111 to 114 is necessary (for example, when driving characteristics of the pixels are sensed), the timing controllers 111 to 114 transmit synchronization request signals CMD_REQ1 to CMD_REQ4 to the bridge IC 200. As indicated by ② in FIG. 11, when the bridge IC 200 receives the synchronization request signals CMD_REQ1 to CMD_REQ4 from all the timing controllers 111 to 114, the bridge IC 200 transmits a synchronization matching completion signal CMD_MATCH to the timing controllers 111 to 114. After the timing controllers 111 to 114 receive the synchronization matching completion signal CMD_MATCH, the timing controllers 111 to 114 simultaneously sense the driving characteristics of the pixels.

When an abnormal situation is generated, the timing controllers 111 to 114 transmit abnormal state flags ABNORMAL_SLV_1 to ABNORMAL_SLV_4 to the bridge IC 200. As indicated by ③ in FIG. 11, when the number of data enable signals DE counted by the timing controllers 111 to 114 is different from a vertical resolution, or a driving voltage such as the high potential pixel driving power voltage EVDD is changed beyond an allowable range, the timing controllers 111 to 114 determine the situation as an abnormal state and generate the abnormal state flags ABNORMAL_SLV_1 to ABNORMAL_SLV_4. As indicated by ④ in FIG. 11, when the bridge IC 200 receives the abnormal state flags ABNORMAL_SLV_1 to ABNORMAL_SLV_4, the bridge IC 200 transmits an abnormal confirmation signal ABNORMAL_MST to the timing controllers 111 to 114 of the abnormal state. The timing controllers 111 to 114 are reset when receiving the abnormal confirmation signal ABNORMAL_MST from the bridge IC 200.

FIG. 12 illustrates an example where the gate drivers of the upper active areas are controlled by one timing controller and the gate drivers of the lower active areas are controlled by one timing controller.

Referring to FIG. 12, the first timing controller 111 simultaneously controls the first and second gate drivers GIP1 and GIP2 so that the scan pulses are simultaneously applied to both ends of each of the gate lines of the upper active areas LU and RU. The first timing controller 111 is connected to the first and second gate drivers GIP1 and GIP2 through a gate timing control signal line 121. The first and second timing controllers 111 and 112 are synchronized with each other by the bridge IC 200 and then simultaneously drive the sensing circuit. Hence, the first and second timing controllers 111 and 112 simultaneously sense the driving characteristics of the pixels of the upper active areas LU and RU and compensate for the pixel data.

The third timing controller 113 simultaneously controls the third and fourth gate drivers GIP3 and GIP4 so that the scan pulses are simultaneously applied to both ends of each of the gate lines of the lower active areas LD and RD. The third timing controller 113 is connected to the third and fourth gate drivers GIP3 and GIP4 through a gate timing control signal line 122. The third and fourth timing controllers 113 and 114 are synchronized with each other by the bridge IC 200, and then simultaneously drive the sensing circuit. Hence, the third and fourth timing controllers 113 and 114 simultaneously sense the driving characteristics of the pixels of the lower active areas LD and RD and compensate for the pixel data. The first and third timing controllers 111 and 113 are synchronized with each other by the bridge IC 200 and then simultaneously transmit the gate timing control signals to the gate drivers GIP1 to GIP4.

The gate timing control signal lines 121 and 122 supplies a start pulse, a shift clock, etc. for controlling operation timing of the shift registers to the gate drivers GIP1~GIP4.

There may be a variation in data output timing between the source driver ICs SIC1 to SIC4. The variation in data output timing between the source driver ICs SIC1 to SIC4 can be minimized by the setting of an source output enable signal option SOE and the setting of a delay option DLY.

FIG. 13 is a flow chart illustrating a real-time sensing method according to an example embodiment.

Referring to FIG. 13, when the timing controllers 111 to 114 receive a sensing start command from the bridge IC 200, the timing controllers 111 to 114 load the compensation value, the parameters, etc. for the external compensation received from the flash memory to the internal memory SRAM to set parameters in steps S1 and S2. Subsequently, as shown in FIG. 11, the timing controllers 111 to 114 are synchronized by the bridge IC 200 in step S3. Next, the timing controllers 111 to 114 drive the sensing circuit and sense in real time driving characteristics (e.g., a threshold voltage or mobility of the driving TFT or the OLED) of pixels on a sensing target line in step S4.

The embodiment generates clocks outside the timing controllers 111 to 114, modulates the clocks by the spread spectrum clock generator, and transmits the modulated clocks to the timing controllers 111 to 114, thereby preventing synchronization mismatch between the timing controllers 111 to 114 resulting from the spread spectrum clock generator inside the timing controller.

Figure 14:
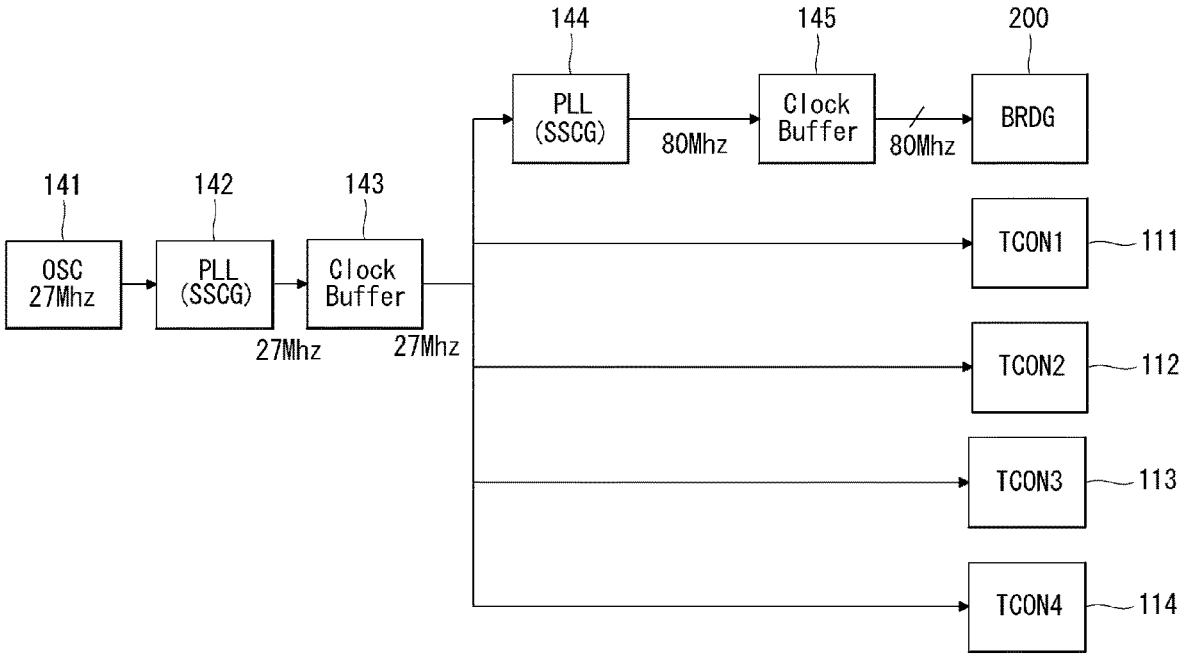
FIG. 14 illustrates an external clock generator.

FIG. 14 illustrates an external clock generator.

Referring to FIG. 14, an external clock generator includes an oscillator (or referred to as "OSC") 141 generating clocks of a predetermined frequency, for example, 27 MHz, a first phase locked loop (or referred to as "PLL") 142, and a first clock buffer 143. The first phase locked loop 142 fixes a frequency and a phase of the clock from the oscillator 141 at a reference frequency. The first phase locked loop 142 includes a spread spectrum clock generator (SSCG). The clock from the oscillator 141 is modulated by the spread spectrum clock generator and is transmitted to the timing controllers 111 to 114 through the clock buffer 143.

It is necessary that a clock frequency of the bridge IC 200 is higher than clock frequencies of the timing controllers 111 to 114. In this instance, a second phase locked loop 144 and a second clock buffer 145 may be added between the first clock buffer 143 and the bridge IC 200. The second phase locked loop 144 multiplies a frequency of the clock received from the first clock buffer 143 and supplies the multiplied frequency of the clock to the bridge IC 200. The second phase locked loop 144 may output a clock of 80 MHz, but is not limited thereto. The second phase locked loop 144 may include a spread spectrum clock generator (SSCG) for modulating the clock. The second clock buffer 145 transfers the clock received from the second phase locked loop 144 to the bridge IC 200. The second phase locked loop 144 and the second clock buffer 145 may be omitted.

Figure 15:
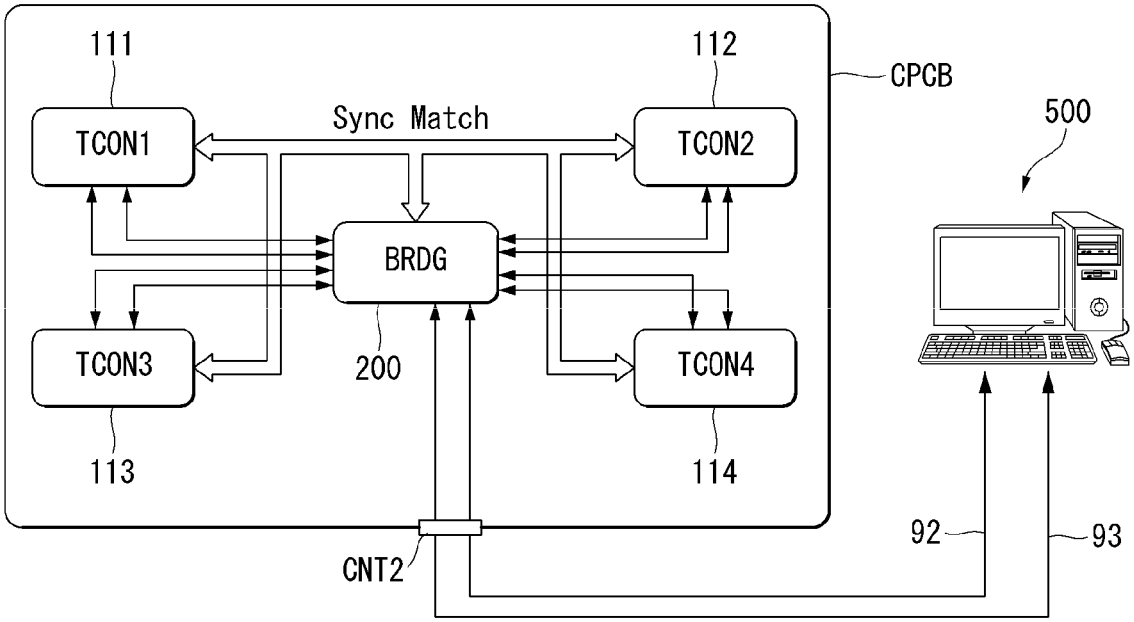
FIG. 15 illustrates an example where a control board is connected to a computer before shipment of the product.
Figure 16:
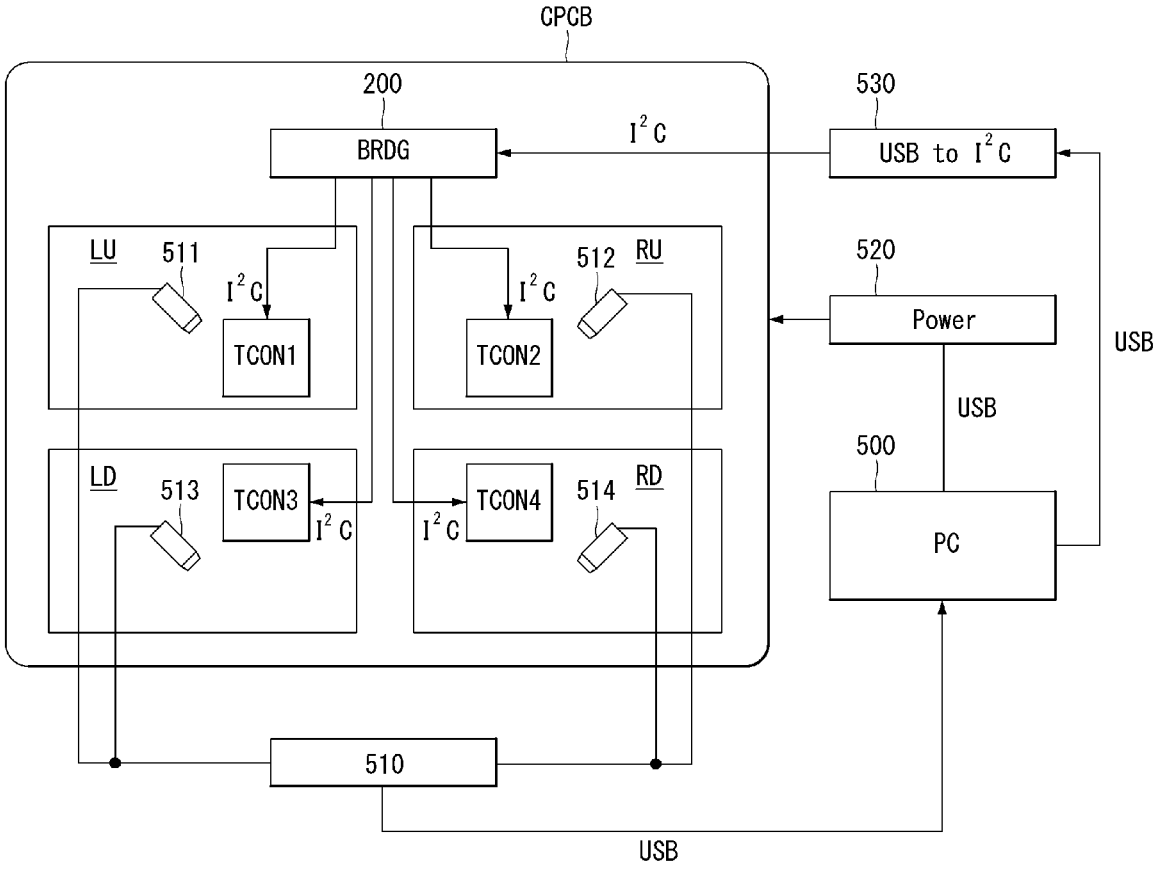
FIG. 16 illustrates a system for making a grayscale-luminance-voltage-current table through the measurement of luminances of four divided active areas.

FIG. 15 illustrates an example where a control board is connected to a computer before shipment of the product. FIG. 16 illustrates a system for making a grayscale-luminance-voltage-current table through the measurement of luminances of four divided active areas.

Referring to FIGS. 15 and 16, in order to achieve the uniform luminance of the screen, a luminance in each of the four divided active areas LU, RU, LD, and RD before shipment of the product is measured at each gray level, and a grayscale-luminance-voltage-current table is made in each active area. A computer 500 is connected to the bridge IC 200 via serial communication, for example, $I^2C$ communication.

Probes 511 to 514 each including a photoelectric element are respectively disposed in front of the active areas LU, RU, LD, and RD. The probes 511 to 514 are connected to a luminance meter 510, and the luminance meter 510 is connected to the computer 500. A power circuit 520 supplies power required to drive the control board CPCB and the computer 500. An interface conversion unit 530 for converting a USB signal into an $I^2C$ signal is disposed in a communication path between the computer 500 and the bridge IC 200.

The computer 500 transmits a test command and test data via the bridge IC 200 and receives a luminance of each active area measured at each gray level of the test data from the luminance meter 510. The computer 500 makes the grayscale-luminance-voltage-current table of each active area at each gray level of pixel data, so that the entire screen represents the same luminance at the same gray level. The computer 500 respectively transmits the grayscale-luminance-voltage-current tables of the active areas to the flash memories 115 to 118 through the bridge IC 200 and respectively stores the grayscale-luminance-voltage-current tables in the flash memories 115 to 118. The computer 500 may transmit the grayscale-luminance-voltage-current tables to the bridge IC 200 via $I^2C$ line 92, and the bridge IC 200 may transmit data of the grayscale-luminance-voltage-current tables to the flash memories 115 to 118.

The computer 500 senses the driving characteristic variation of each pixel through the sensing circuit and transmits compensation values for averaging the driving characteristic variations of the pixels to the flash memories 115 to 118 through the bridge IC 200. The computer 500 transmits parameters for the function setting of the timing controllers 111 to 114 to the flash memories 115 to 118 through the bridge IC 200. The computer 500 may transmit the compensation values of the pixels to the bridge IC 200 via an LVDS line 93.

When power is input, each of the timing controllers 111 to 114 loads the grayscale-luminance-voltage-current table from the flash memories 115 to 118 to the internal memory SRAM and modulates the gray levels of pixel data using the grayscale-luminance-voltage-current table. Further, each of the timing controllers 111 to 114 modulates the pixel data using the compensating value for compensating for the driving characteristic variation of the pixel and transmits the modulated pixel data to the source driver IC SIC. When the timing controllers 111 to 114 independently execute a grayscale-to-luminance calculation algorithm, a temperature compensation algorithm, an external compensation algorithm based on a result of sensing the pixels, and the like in the active areas, a boundary surface may be seen by a difference in the luminance and the color between the active areas. The bridge IC 200 integrally manages the operation results of algorithms received from the timing controllers 111 to 114 and executes an algorithm for correcting the luminance difference and the color difference at the boundary surface between the active areas. The bridge IC 200 executes a luminance-grayscale compensation algorithm, an error diffusion algorithm, etc. on the pixel data to be written to the boundary surface between the active areas using the operation result of algorithms received from each of the timing controllers 111 to 114 and transmits the operation result of algorithms executed on the pixel data to the timing controllers 111 to 114. Hence, the timing controllers 111 to 114 reflect the operation result of algorithms and error data at the boundary surface and perform an algorithm operation. Thus, the embodiments can implement an image of high image quality, in which the boundary surface is not seen on the screen divided into the active areas, using the bridge IC 200.

Figure 17:
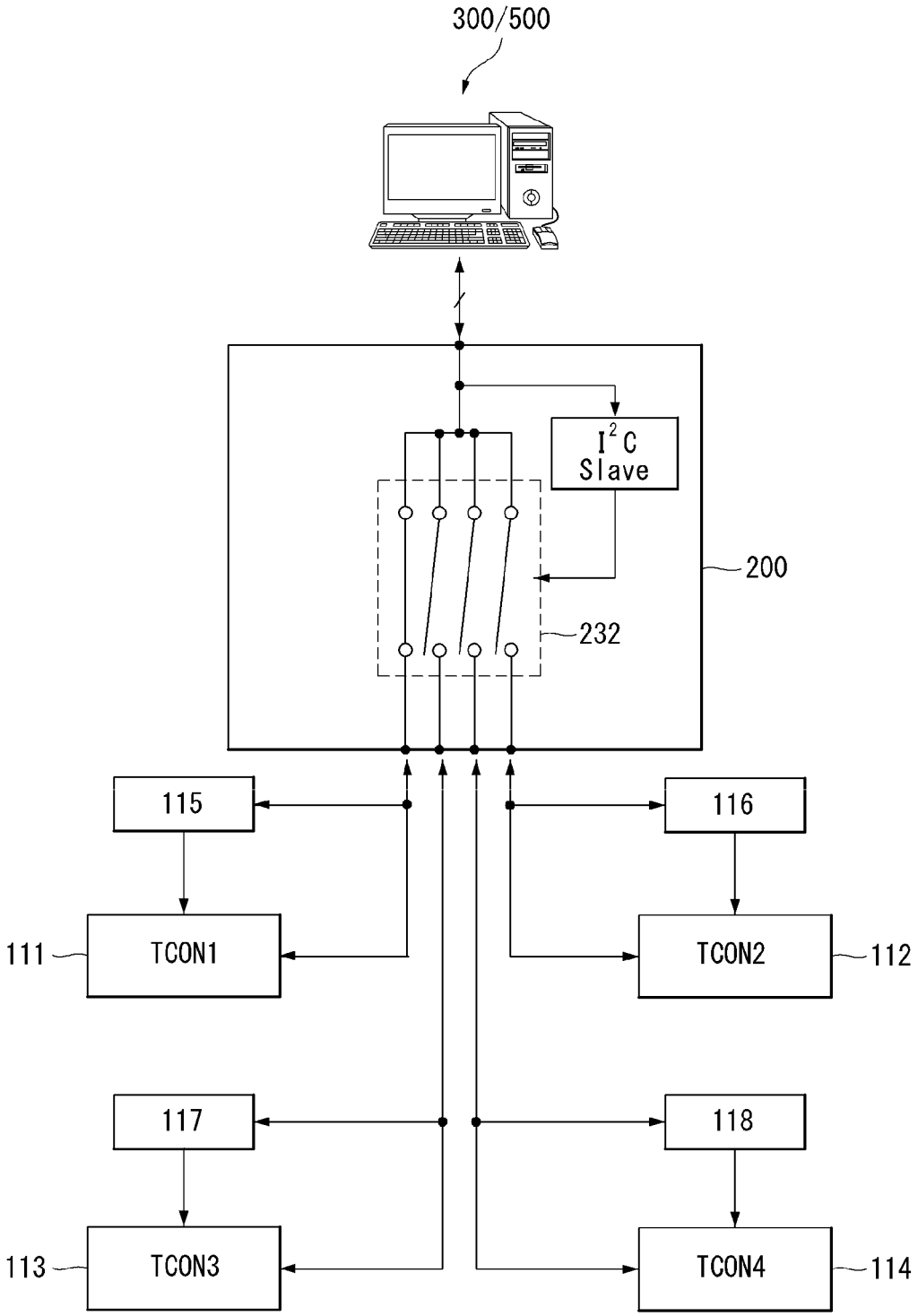
FIG. 17 illustrates a switching circuit of a bridge IC.

FIG. 17 illustrates a switching circuit of the bridge IC 200.

As shown in FIG. 17, the bridge IC 200 includes a switching circuit 232. The switching circuit 232 switches on and off a communication path between the computer 500 and the timing controllers 111 to 114 before shipment of the product and switches on and off a communication path between the host system 300 and the timing controllers 111 to 114 after shipment of the product. An on-sequence and an off-sequence of the switching circuit 232 may be set depending on the register setting value. Before shipment of the product, the bridge IC 200 temporarily connects the computer 500 to the timing controllers 111 to 114 and the flash memories 115 to 118 using the switching circuit 232. The bridge IC 200 transmits a luminance control command or a power-on/off sequence command received from the host system 300 to the timing controllers 111 to 114 using the switching circuit 232.

The embodiments are not limited to an example where four timing controllers are connected to one bridge. For example, the embodiments may be applied to an example where the screen of the display panel is divided into two active areas that are respectively controlled by two timing controllers.

As described above, the embodiments connect two or more timing controllers, that each have a small capacity and dividedly control pixels of the active areas, to one bridge circuit, and synchronize the timing controllers using the bridge circuit, thereby sensing and compensating for the driving characteristics of the pixels and integrally correcting the image quality operation results of the timing controllers. As a result, the embodiments can achieve the uniform image quality throughout the entire screen while the boundary surface between the active areas is not visible.

The embodiments completely synchronize the timing controllers using the bridge circuit and then apply the scan pulses to the gate lines, thereby sensing and normally driving the pixels throughout the entire screen.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. An electroluminescent display comprising:

first and second active areas divided from a screen on which data lines and gate lines intersect each other and pixels are disposed;

a first driving circuit configured to write pixel data to pixels of the first active area;

a first timing controller configured to transmit the pixel data of the first active area to be displayed on the first active area to the first driving circuit and control the first driving circuit;

a second driving circuit configured to write pixel data to pixels of the second active area;

a second timing controller configured to transmit the pixel data of the second active area to be displayed on the second active area to the second driving circuit and control the second driving circuit; and a bridge circuit configured to receive an input image from a host system, divide the input image to correspond to the first and second active areas, modulate the input image, distribute the input image to the first and second timing controllers and synchronize the first and second timing controllers when receiving a synchronization request signal from the first and second timing controllers through a communication path connected to the first and second timing controllers.

2. The electroluminescent display of claim 1, wherein the bridge circuit operations as a master element on the communication path and transmits a synchronization matching completion signal to the first and second timing controllers after the synchronization request signal is received from all the first and second timing controllers.

3. The electroluminescent display of claim 2, wherein the gate lines cross the first and second active areas, wherein the first driving circuit includes:

a first data driver connected to data lines of the first active area and supplying data signals to the data lines of the first active area; and a first gate driver connected to one ends of the gate lines, wherein the second driving circuit includes:

a second data driver connected to data lines of the second active area and supplying data signals to the data lines of the second active area; and a second gate driver connected to the other ends of the gate lines.

4. The electroluminescent display of claim 3, wherein after the synchronization matching completion signal is received from the bridge circuit, at least one of the first and second timing controllers drives the first and second gate drivers and supplies scan pulses to the gate lines.

5. The electroluminescent display of claim 3, further comprising a sensing circuit configured to sense driving characteristics of the pixels.

6. The electroluminescent display of claim 5, wherein after the synchronization matching completion signal is received from the bridge circuit, the first and second timing controllers drive the first and second driving circuits and the sensing circuit and sense the driving characteristics of the pixels in real time.

7. The electroluminescent display of claim 1, wherein the first and second timing controllers each transmit an abnormal state flag to the bridge circuit in an abnormal state, and wherein the bridge circuit resets at least any one of the first and second timing controllers when receiving the abnormal state flag.

8. The electroluminescent display of claim 1, further comprising a host system configured to transmit an image signal to the bridge circuit, wherein the bridge circuit includes a switching circuit configured to switch on and off a communication path between the host system and the first and second timing controllers.

9. The electroluminescent display of claim 8, further comprising:

a first memory connected to the first timing controller;

a second memory connected to the second timing controller; and a computer temporarily connected to the first and second memories through the bridge circuit before shipment of the product and configured to transmit a grayscale-luminance-voltage-current table and a compensation value compensating for driving characteristic variations of the pixels to each of the first and second memories, wherein the switching circuit of the bridge circuit switches on and off a communication path between the computer and the first and second memories in a process performed before shipment of the product.

10. The electroluminescent display of claim 1, further comprising:

a first phase locked loop configured to output a clock while modulating the clock using a first spread spectrum clock generator; and a first clock buffer configured to transfer the clock received from the first phase locked loop to the first and second timing controllers.

11. The electroluminescent display of claim 10, further comprising:

a second phase locked loop disposed between the first clock buffer and the bridge circuit and configured to multiply a frequency of the clock received from the first clock buffer and output the clock while modulating the multiplied frequency of the clock using a second spread spectrum clock generator; and a second clock buffer configured to transfer the clock received from the second phase locked loop to the bridge circuit.

12. An electroluminescent display comprising:

a first active area disposed in an upper left portion of a screen;

a second active area disposed in an upper right portion of the screen;

a third active area disposed in a lower left portion of the screen;

a fourth active area disposed in a lower right portion of the screen;

a first driving circuit configured to write pixel data to pixels of the first active area;

a first timing controller configured to transmit the pixel data of the first active area to be displayed on the first active area to the first driving circuit and control the first driving circuit;

a second driving circuit configured to write pixel data to pixels of the second active area;

a second timing controller configured to transmit the pixel data of the second active area to be displayed on the second active area to the second driving circuit and control the second driving circuit;

a third driving circuit configured to write pixel data to pixels of the third active area;

a third timing controller configured to transmit the pixel data of the third active area to be displayed on the third active area to the third driving circuit and control the third driving circuit;

a fourth driving circuit configured to write pixel data to pixels of the fourth active area;

a fourth timing controller configured to transmit the pixel data of the fourth active area to be displayed on the fourth active area to the fourth driving circuit and control the fourth driving circuit; and a bridge circuit configured to receive an input image from a host system, divide the input image to correspond to the first to fourth active areas, modulate the input image, distribute the input image to the first to fourth timing controllers and synchronize the first to fourth timing controllers when receiving a synchronization request signal from the first to fourth timing controllers through a communication path connected to the first to fourth timing controllers.

13. The electroluminescent display of claim 12, wherein the bridge circuit operations as a master element on the communication path and transmits a synchronization matching completion signal to the first to fourth timing controllers after the synchronization request signal is received from all the first to fourth timing controllers.

14. The electroluminescent display of claim 13, wherein each of the first to fourth active areas includes data lines, gate lines intersecting the data lines, and the pixels, wherein gate lines of the first and second active areas cross the first and second active areas, wherein gate lines of the third and fourth active areas cross the third and fourth active areas, and wherein the data lines are separated with a boundary between the first and second active areas and the third and fourth active areas interposed therebetween.

15. The electroluminescent display of claim 14, wherein the first driving circuit includes:

a first data driver connected to data lines of the first active area and supplying data signals to the data lines of the first active area; and a first gate driver connected to one ends of the gate lines crossing the first and second active areas, wherein the second driving circuit includes:

a second data driver connected to data lines of the second active area and supplying data signals to the data lines of the second active area; and a second gate driver connected to the other ends of the gate lines crossing the first and second active areas, wherein the third driving circuit includes:

a third data driver connected to data lines of the third active area and supplying data signals to the data lines of the third active area; and a third gate driver connected to one ends of the gate lines crossing the third and fourth active areas, and wherein the fourth driving circuit includes:

a fourth data driver connected to data lines of the fourth active area and supplying data signals to the data lines of the fourth active area; and a fourth gate driver connected to the other ends of the gate lines crossing the third and fourth active areas.

16. The electroluminescent display of claim 15, wherein after the synchronization matching completion signal is received from the bridge circuit, at least one of the first and second timing controllers drives the first and second gate drivers and supplies scan pulses to the gate lines crossing the first and second active areas, wherein after the synchronization matching completion signal is received from the bridge circuit, at least one of the third and fourth timing controllers drives the third and fourth gate drivers and supplies scan pulses to the gate lines crossing the third and fourth active areas, and wherein a scanning direction of the scan pulses applied to the gate lines of the first and second active areas is opposite to a scanning direction of the scan pulses applied to the gate lines of the third and fourth active areas.

17. The electroluminescent display of claim 15, further comprising a sensing circuit configured to sense driving characteristics of the pixels.

18. The electroluminescent display of claim 17, wherein after the synchronization matching completion signal is received from the bridge circuit, the first to fourth timing controllers drive the first to fourth driving circuits and the sensing circuit and sense the driving characteristics of the pixels in real time.

19. The electroluminescent display of claim 12, further comprising:

a first phase locked loop configured to output a clock while modulating the clock using a first spread spectrum clock generator; and a first clock buffer configured to transfer the clock received from the first phase locked loop to the first to fourth timing controllers.

20. A driving device of an electroluminescent display comprising:

a first timing controller configured to transmit pixel data of a first active area to be displayed on the first active area to a first driving circuit writing pixel data to pixels of the first active area and control the first driving circuit;

a second timing controller configured to transmit pixel data of a second active area to be displayed on the second active area to a second driving circuit writing pixel data to pixels of the second active area and control the second driving circuit; and a bridge circuit configured to receive an input image from a host system, divide the input image to correspond to the first and second active areas, modulate the input image, distribute the input image to the first and second timing controllers and synchronize the first and second timing controllers when receiving a synchronization request signal from the first and second timing controllers through a communication path connected to the first and second timing controllers.

21. The driving device of the electroluminescent display of claim 20, further comprising:

a plurality of memories respectively connected to the timing controllers and configured to store a compensation value of the pixels of each active area and a grayscale-luminance-voltage-current table of each active area, wherein the bridge circuit includes a switching circuit configured to switch on and off a communication path between the host system and the timing controllers.

* * * * *